US011975940B2

(12) United States Patent
Takeuchi

(10) Patent No.: US 11,975,940 B2
(45) Date of Patent: May 7, 2024

(54) IMAGE FORMING APPARATUS AND SHEET AMOUNT DETECTION METHOD

(71) Applicant: TOSHIBA TEC KABUSHIKI KAISHA, Tokyo (JP)

(72) Inventor: Kosuke Takeuchi, Sunto Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/732,381

(22) Filed: Apr. 28, 2022

(65) Prior Publication Data

US 2022/0363500 A1 Nov. 17, 2022

(30) Foreign Application Priority Data

May 14, 2021 (JP) ..... 2021-082478

(51) Int. Cl.
*B65H 7/14* (2006.01)

(52) U.S. Cl.
CPC ..... *B65H 7/14* (2013.01); *B65H 2511/15* (2013.01); *B65H 2511/212* (2013.01); *B65H 2553/412* (2013.01); *B65H 2553/414* (2013.01); *B65H 2553/416* (2013.01)

(58) Field of Classification Search
CPC ... B65H 1/08; B65H 7/02; B65H 7/14; B65H 2405/1117; B65H 2511/15; B65H 2511/21; B65H 2511/212; B65H 2553/40; B65H 2553/41; B65H 2553/412; B65H 2553/414; B65H 2553/416
See application file for complete search history.

(56) References Cited

U.S. PATENT DOCUMENTS

| | | | | |
|---|---|---|---|---|
| 2006/0087070 | A1* | 4/2006 | Cook | B65H 1/00 271/145 |
| 2011/0169215 | A1* | 7/2011 | Oh | B65H 1/266 271/265.01 |
| 2013/0243448 | A1* | 9/2013 | Naoi | B65H 1/18 399/23 |
| 2015/0183596 | A1* | 7/2015 | Shimazu | B65H 1/266 271/153 |
| 2016/0297630 | A1 | 10/2016 | Doyo | |
| 2017/0003635 | A1 | 1/2017 | Koga | |
| 2017/0341889 | A1* | 11/2017 | Kikuta | B65H 1/04 |
| 2018/0105378 | A1* | 4/2018 | Akamatsu | B65H 7/14 |
| 2019/0002220 | A1* | 1/2019 | Daigo | B65H 1/14 |
| 2019/0062079 | A1 | 2/2019 | Kikuta | |

* cited by examiner

*Primary Examiner* — Prasad V Gokhale
(74) *Attorney, Agent, or Firm* — Kim & Stewart LLP

(57) ABSTRACT

An image forming apparatus includes a sensor, a tray, a gear, a protruding portion, and a processor. The sensor has a light transmitting unit and light receiving units and is configured to generate an output signal in accordance with an amount of light received by the light receiving units. The gear is configured to rotate in accordance with an amount of sheets stacked on the tray. The protruding portion is configured to rotate with the gear and move into a light path of light emitted from the light emitting unit to the light receiving units to partially block the light, the protruding portion having a width that determines how much light in the light path is blocked and varies gradually from a first end thereof to a second end thereof. The processor is configured to determine the amount of sheets stacked on the tray based on the output signal.

19 Claims, 20 Drawing Sheets

IMAGE FORMING APPARATUS AND SHEET AMOUNT DETECTION METHOD

CROSS-REFERENCE TO RELATED APPLICATION

This application is based upon and claims the benefit of priority from Japanese Patent Application No. 2021-082478, filed on May 14, 2021, the entire contents of which are incorporated herein by reference.

FIELD

Embodiments described herein relate to an image forming apparatus and a sheet amount detection method.

BACKGROUND

Conventional detection methods for the remaining amount of sheet in a sheet storage portion of an image forming apparatus use a protruding portion of a gear body, a photosensor, and an integrated circuit (IC). The protruding portion has a slit and the photosensor is configured to detect light passing through the slit. The IC is configured to record when the light passes through the slit. However, the conventional detection method has a problem of low accuracy of the detected remaining amount of sheet.

DETAILED DESCRIPTION

In general, according to one embodiment, an image forming apparatus capable of outputting a remaining amount of sheets stored in a sheet feed tray with higher accuracy is provided.

According to an embodiment, an image forming apparatus includes a sensor, a tray on which sheets are to be stacked, a gear, a protruding portion, and a processor. The sensor has a light transmitting unit and an array of light receiving units and is configured to generate an output signal in accordance with an amount of light received by the light receiving units. The gear is configured to rotate in accordance with an amount of sheets stacked on the tray. The protruding portion is configured to rotate with the gear and move into a light path of light emitted from the light emitting unit to the light receiving units to partially block light in the light path. The protruding portion has a width that determines how much light in the light path is blocked and varies gradually from a first end thereof to a second end. The processor is configured to determine the amount of sheets stacked on the tray based on the output signal.

Hereinafter, an embodiment of an image forming apparatus 10 will be described with reference to drawings.

Figure 1:
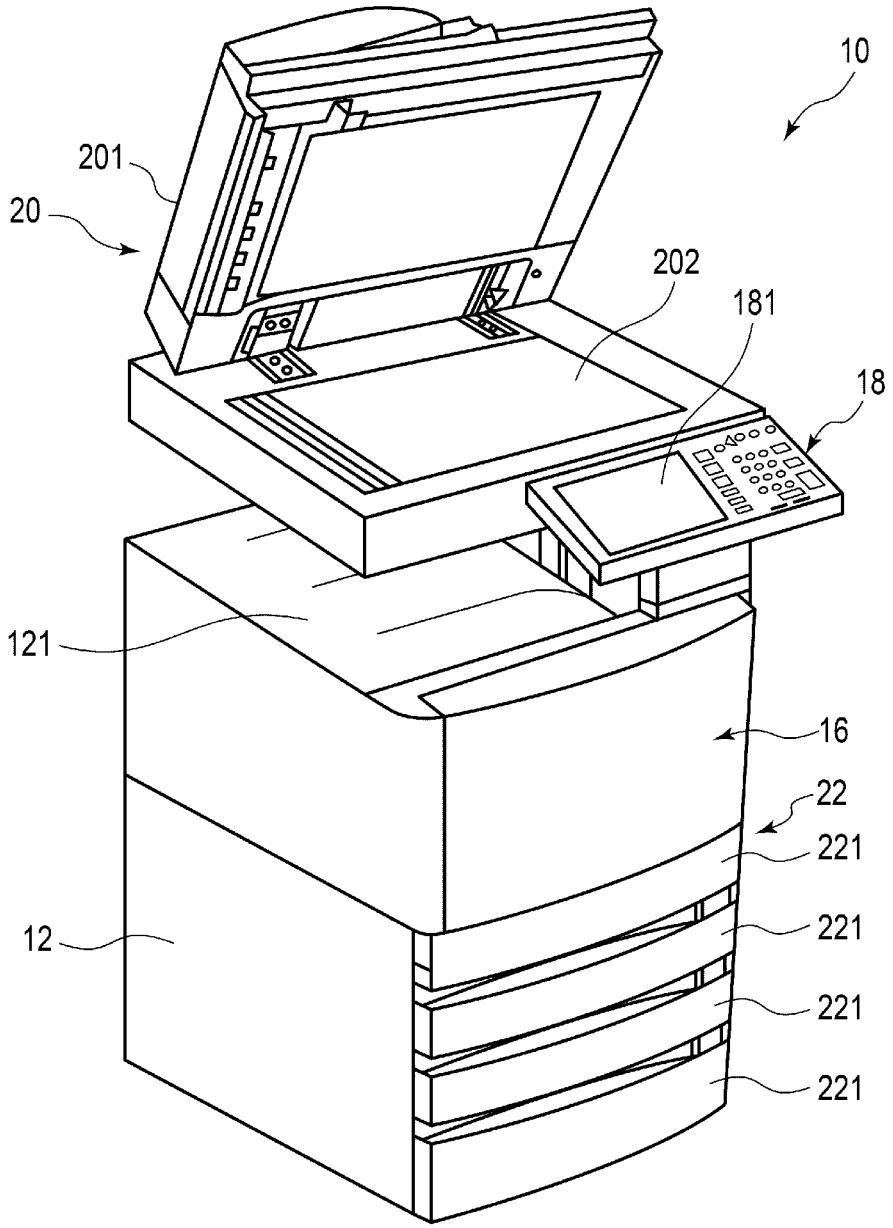
FIG. 1 is a schematic perspective view showing an image forming apparatus according to an embodiment.
Figure 2:
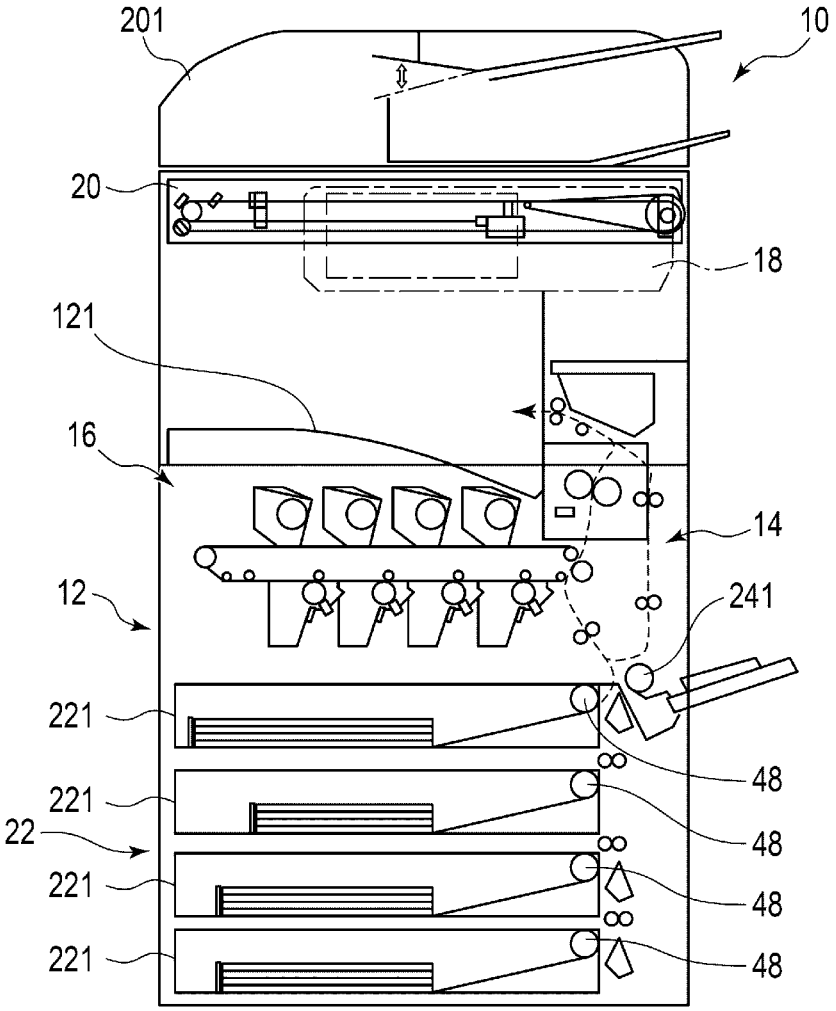
FIG. 2 is a schematic view showing a front view of the image forming apparatus.

The image forming apparatus 10 shown in FIGS. 1 and 2 is, for example, a multi-function peripheral (MFP). The image forming apparatus 10 includes a main body 12, a conveying unit 14, a printer 16, a control panel 18 including a display 181, a scanner 20, and a sheet feed tray storage unit 22.

Figure 3:
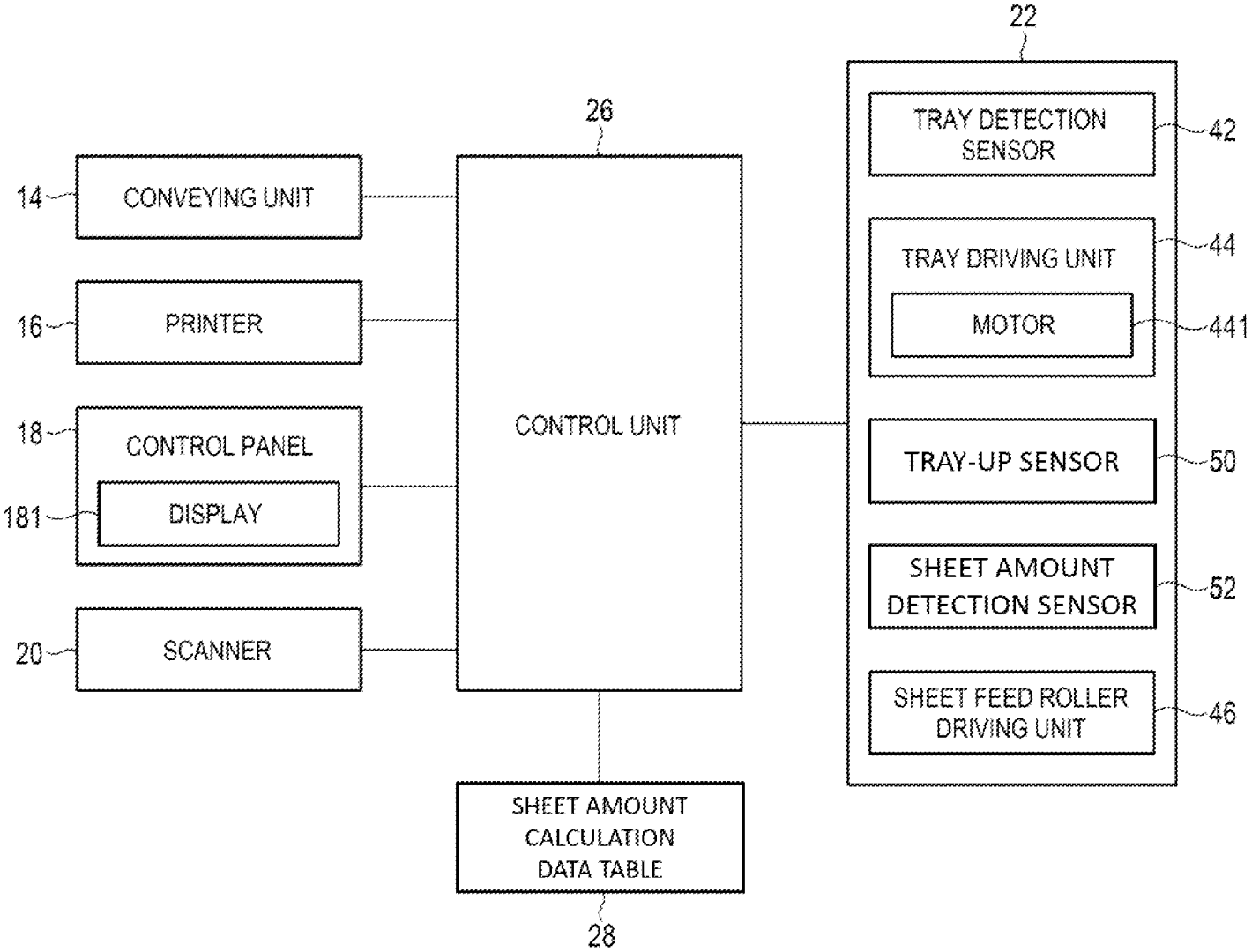
FIG. 3 is a schematic block diagram of the image forming apparatus.

As shown in FIG. 3, the image forming apparatus 10 further includes a control unit 26 and a sheet amount calculation data table 28. The conveying unit 14, the printer 16, the control panel 18, the scanner 20, the sheet feed tray storage unit 22, and the control unit 26 are provided in the main body 12. The control unit 26 controls the conveying unit 14, the printer 16, the control panel 18, the scanner 20, the sheet feed tray storage unit 22, and the sheet amount calculation data table 28.

As shown in FIGS. 1 and 2, for example, a plurality of stages of sheet feed trays 221 arranged in a vertical direction are disposed in the sheet feed tray storage unit 22. The sheet feed trays 221 store, for example, a plurality of sheets as paper sheets (referred to as image forming medium) in a stacked manner. The sheets are, for example, paper or label sheets. The paper sheet may be any sheet as long as an image can be formed on a surface thereof.

A side where openings through which a user stores the sheet feed trays 221 into and pulls out the sheet feed trays 221 from the sheet feed tray storage unit 22 are provided, is defined as a front surface side of the image forming apparatus 10. A back surface side of the image forming apparatus 10 is a side opposite the front surface side. The image forming apparatus 10 is used in a state where the sheet feed trays 221 are stored in the sheet feed tray storage unit 22. In the present embodiment, the sheet feed tray storage unit 22 takes out the sheets stored in the sheet feed trays 221 one by one, for example, to a downstream side in a sheet feed direction on a right side when viewed from the front surface side of the image forming apparatus 10.

The conveying unit 14 conveys the sheet to the printer 16. The sheet taken out from the sheet feed tray 221 is conveyed to the printer 16 by the conveying unit 14. The printer 16 forms an image on the sheet by using, for example, a developer such as a toner. After the image is formed on the sheet by the printer 16, the conveying unit 14 conveys the sheet to a sheet discharge unit 121 of the main body 12.

The control panel 18 is an operation input unit by which the user of the image forming apparatus 10 inputs an instruction to the control unit 26. The display 181 of the control panel 18 displays various pieces of information such as icons and error displays related to the image forming apparatus 10 based on a signal output from the control unit 26. The display 181 displays a remaining amount of sheets in the sheet feed tray 221 based on a signal output from the control unit 26.

The scanner 20 is provided, for example, above the sheet discharge unit 121 of the main body 12. The scanner 20 includes an automatic document feeder (ADF) 201 and a platen glass 202. The automatic document feeder 201 is supported so as to be rotatable with respect to the main body 12. In a state where the ADF 201 is closed, the ADF 201 covers an entire document reading region on the platen glass 202.

Figure 4:
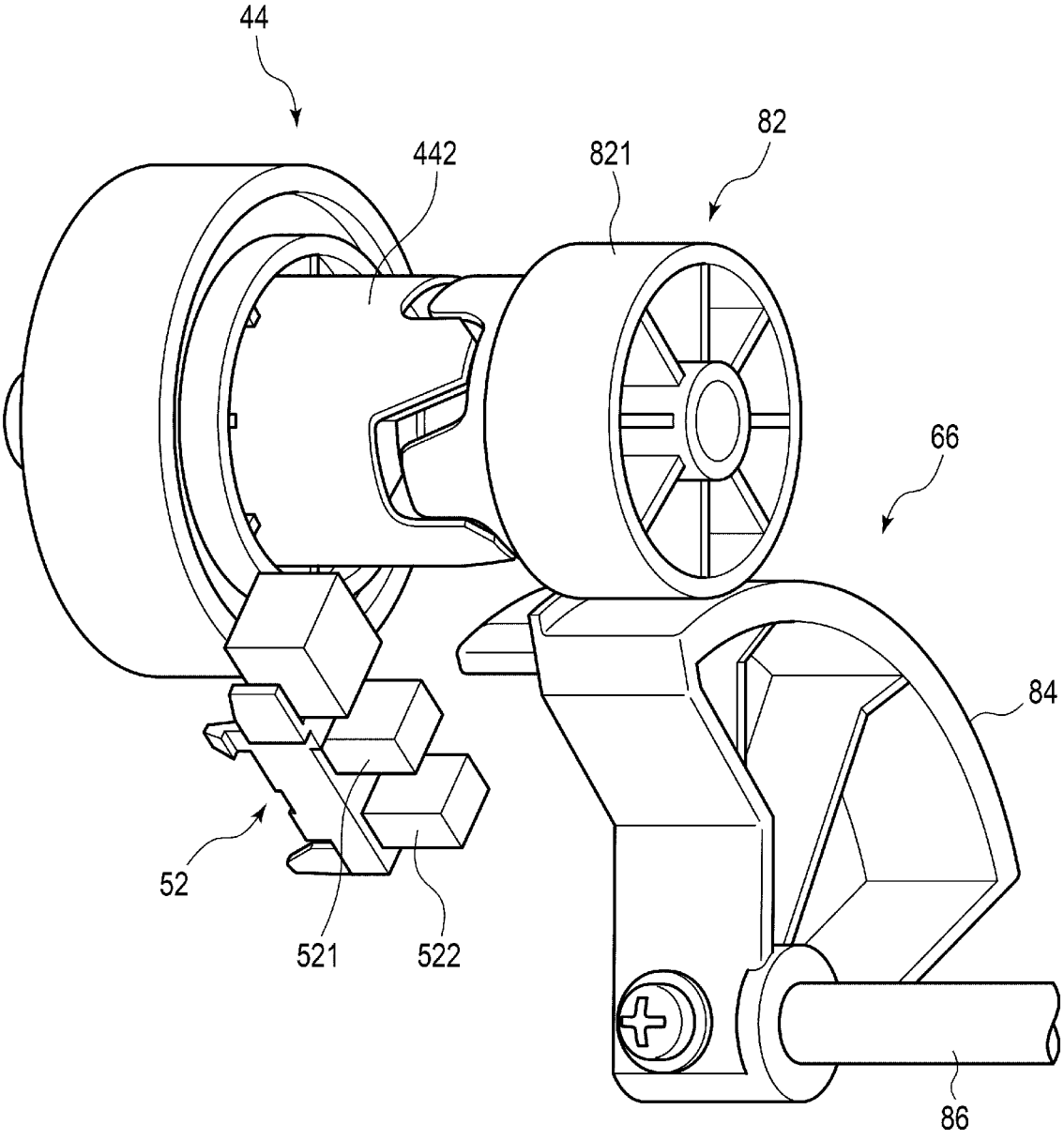
FIG. 4 is a schematic perspective view showing a positional relationship between a tray-up mechanism on a sheet feed tray side, and a tray driving unit and a sheet amount detection sensor on a main body side.

FIG. 4 shows a positional relationship between a first coupling 442 and a sheet amount detection sensor 52 that are disposed in the sheet feed tray storage unit 22, and a positional relationship between a second coupling 82 of the sheet feed tray 221 coupled to the first coupling 442 and a tray-up gear 84 that meshes with an outer peripheral gear 821 of the second coupling 82.

As shown in FIGS. 2, 3, and 4, the sheet feed tray storage unit 22 includes a tray detection sensor 42, a tray driving unit 44, a sheet feed roller driving unit 46, sheet feed rollers 48, a tray-up sensor 50, and the sheet amount detection sensor 52.

The tray detection sensor 42 detects attachment and detachment of the sheet feed tray 221 with respect to a predetermined position of the sheet feed tray storage unit 22.

The tray driving unit 44 shown in FIG. 4 includes a motor 441 (see FIG. 3) and the first coupling 442 that is driven by the motor 441 to rotate. The first coupling 442 rotates in a predetermined direction by the motor 441.

The sheet feed roller driving unit 46 shown in FIG. 3 drives the sheet feed rollers 48 according to a command from the control unit 26 when the image is to be printed using the image forming apparatus 10.

The sheet feed rollers 48 shown in FIG. 2 are disposed, for example, above a side plate 742. The sheet feed rollers 48 are in contact with the sheets placed on the sheet feed trays 221. The sheet feed rollers 48 are driven by the sheet feed roller driving unit 46 and take out the sheets one by one from the sheet feed trays 221. That is, the sheet feed rollers 48 feed the sheets placed in a sheet storage portion 62 in a direction intersecting with a direction in which the sheet storage portion 62 is attached to the sheet feed tray storage unit 22 and a direction in which the sheet storage portion 62 is detached from the sheet feed tray storage unit 22.

The tray-up sensor 50 shown in FIG. 3 detects that the sheet comes into contact with the sheet feed roller and that the sheet is separated from the sheet feed roller 48 due to rising and lowering of an end portion 902 of a second rotation plate 90 (described later) of the sheet feed tray 221 on the downstream side in the sheet feed direction.

The sheet amount detection sensor 52 shown in FIG. 4 outputs, to the control unit 26, a signal based on an operation of the gear 84 on a sheet feed tray 221 side that operates in conjunction with rotation of the first coupling 442.

Figure 5:
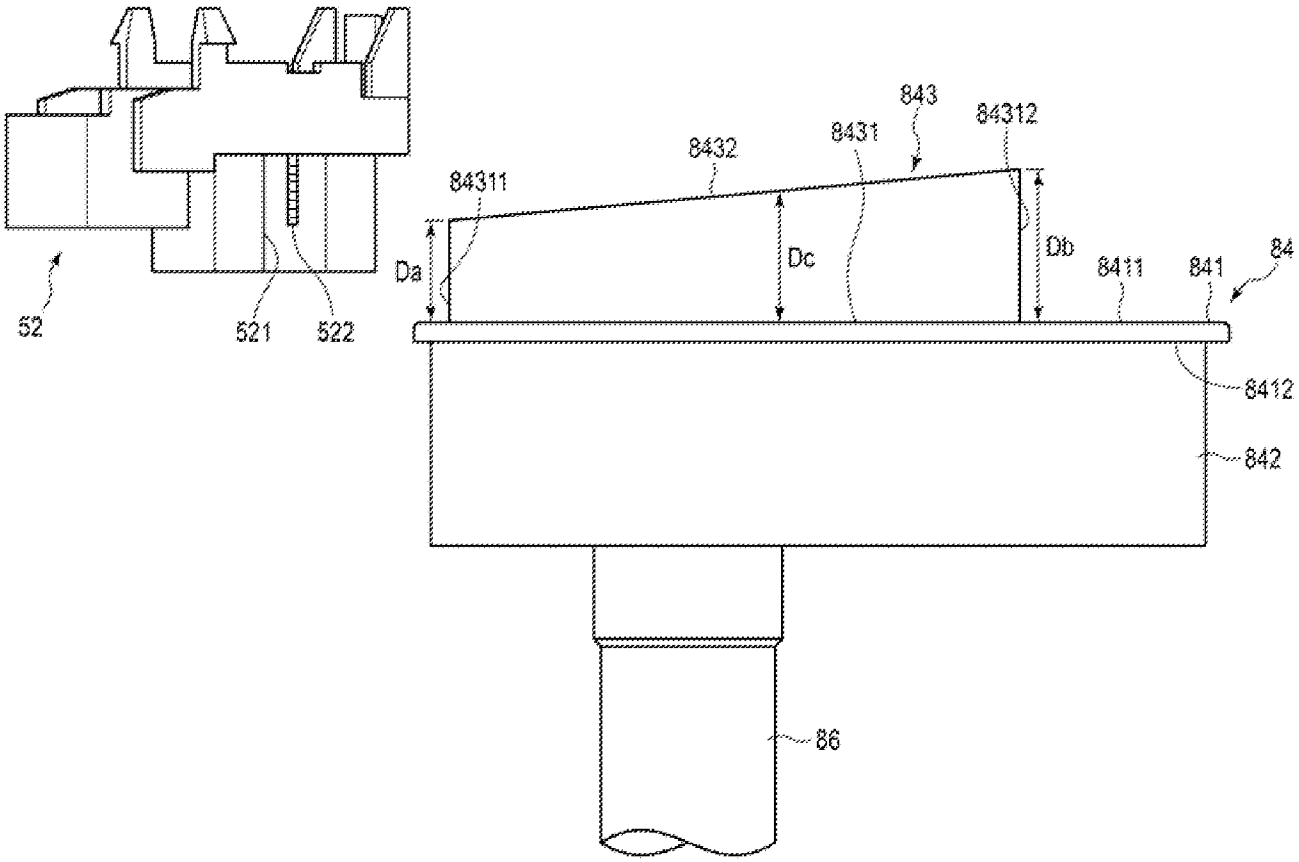
FIG. 5 is a schematic view of the sheet amount detection sensor on the main body side and a tray-up gear on the sheet feed tray side as viewed from above.

FIG. 5 is a schematic view showing a positional relationship between the sheet amount detection sensor 52 and the tray-up gear 84 as viewed from above the main body 12 of the image forming apparatus 10. An example is shown in which the tray-up gear 84 in FIG. 5 is disposed at a first position where the sheet feed tray 221 is detached from the sheet feed tray storage unit 22.

The sheet amount detection sensor 52 shown in FIG. 5 includes a light emitting unit 521 and a plurality of light receiving units 522 that face the light emitting unit 521 and are arranged, for example, in a direction along an attachment direction and a detachment direction of the sheet feed tray 221 with respect to the sheet feed tray storage unit 22, that is, in a direction along an axial direction of a rotation axis of a gear body 841. As the plurality of light receiving units 522, for example, twenty light receiving elements are arranged in, for example, one direction. The number of the light receiving units 522 can be set as appropriate.

In the present embodiment, in the light emitting unit 521 and the light receiving units 522, a direction of light from the light emitting unit 521 to the light receiving unit 522 is not horizontal and is inclined. Depending on the positional relationship with the tray-up gear 84, the light emitting unit 521 and the light receiving units 522 may be disposed such that the direction of the light from the light emitting unit 521 to the light receiving unit 522 is horizontal.

Figure 6:
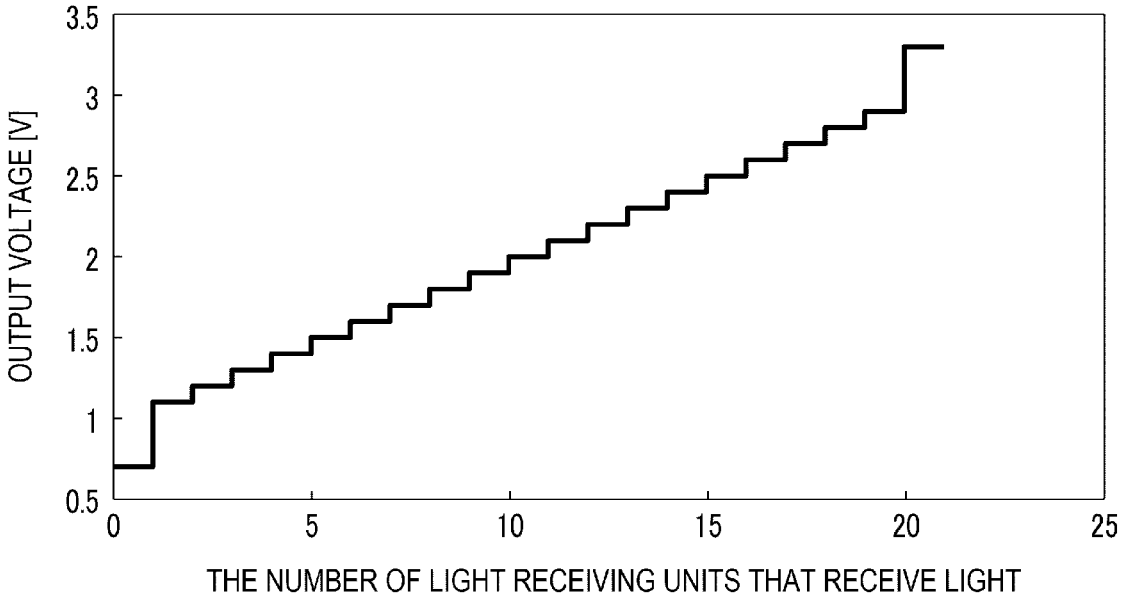
FIG. 6 is a graph showing a relationship between the number of light receiving units that receive light and an output voltage based on the number.

FIG. 6 shows an example of an output signal with respect to the number of light receiving units that receive light from the light emitting unit 521 among, for example, twenty light receiving units 522. As shown in FIG. 6, when twenty light receiving units 522 among the twenty light receiving units 522 receive the light from the light emitting unit 521, the sheet amount detection sensor 52 outputs a signal of 3.3 V. For example, when nineteen light receiving units 522 among the twenty light receiving units 522 receive the light from the light emitting unit 521, the sheet amount detection sensor 52 outputs a signal of 2.9 V. For example, when eighteen light receiving units 522 among the twenty light receiving units 522 receive the light from the light emitting unit 521, the sheet amount detection sensor 52 outputs a signal of 2.8 V. When one light receiving unit 522 among the twenty light receiving units 522 receives the light from the light emitting unit 521, the sheet amount detection sensor 52 outputs a signal of 1.1 V. When no light receiving unit 522 receives the light from the light emitting unit 521 among the twenty light receiving units 522, the sheet amount detection sensor 52 outputs a signal of 0.7 V. In this way, the sheet amount detection sensor 52 performs the output of 20 different levels depending on the number of light receiving units 522 that receive light among the plurality of light receiving units 522. The sheet amount detection sensor 52 according to the present embodiment decreases the output signal from the sheet amount detection sensor 52 stepwise by 0.1 V as the number of light receiving units 522 that receive light among the twenty light receiving units 522 decreases from 19 to 1. In other words, the sheet amount detection sensor 52 increases the output signal stepwise by 0.1 V as the number of light receiving units 522 that receive light among the twenty light receiving units 522 increases from 1 to 19. Such a relationship between the number of light receiving units 522 that receive light and the output signal (e.g., voltage) is represented as shown in FIG. 6.

The sheet amount calculation data table 28 is connected to the control unit 26. As an example, the following correspondence relationship is stored in the sheet amount calculation data table 28 according to a positional relationship between the sheet amount detection sensor 52 and a protruding portion 843 of the tray-up gear 84 described later.

When the number of light receiving units that receive light is 19 (the output voltage is 2.9 V), the remaining amount of sheets is 100%; when the number of light receiving units that receive light is 18 (the output voltage is 2.8 V), the remaining amount of sheets is 93%; when the number of light receiving units that receive light is 17 (the output voltage is 2.7 V), the remaining amount of sheets is 87%; when the number of light receiving units that receive light is 16 (the output voltage is 2.6 V), the remaining amount of sheets is 80%; when the number of light receiving units that receive light is 15 (the output voltage is 2.5 V), the remaining amount of sheets is 73%; when the number of light receiving units that receive light is 14 (the output voltage is 2.4 V), the remaining amount of sheets is 67%; when the number of light receiving units that receive light is 13 (the output voltage is 2.3 V), the remaining amount of sheets is 60%; when the number of light receiving units that receive light is 12 (the output voltage is 2.2 V), the remaining amount of sheets is 53%; when the number of light receiving units that receive light is 11 (the output voltage is 2.1 V), the remaining amount of sheets is 47%; when the number of light receiving units that receive light is 10 (the output voltage is 2.0 V), the remaining amount of sheets is 40%; when the number of light receiving units that receive light is 9 (the output voltage is 1.9 V), the remaining amount of sheets is 33%; when the number of light receiving units that receive light is 8 (the output voltage is 1.8 V), the remaining amount of sheets is 27%; when the number of light receiving units that receive light is 7 (the output voltage is 1.7 V), the remaining amount of sheets is 20%; when the number of light receiving units that receive light is 6 (the output voltage is 1.6 V), the remaining amount of sheets is 13%; when the number of light receiving units that receive light is 5 (the output voltage is 1.5 V), the remaining amount of sheets is 7%; when the number of light receiving units that receive light is 4 (the output voltage is 1.4 V), the remaining amount of sheets is 0%. Therefore, the control unit 26 detects the output voltage of the detection sensor 52 and outputs an amount of sheets present in the sheet feed tray 221 as a relative amount with respect to a maximum amount.

Figure 7:
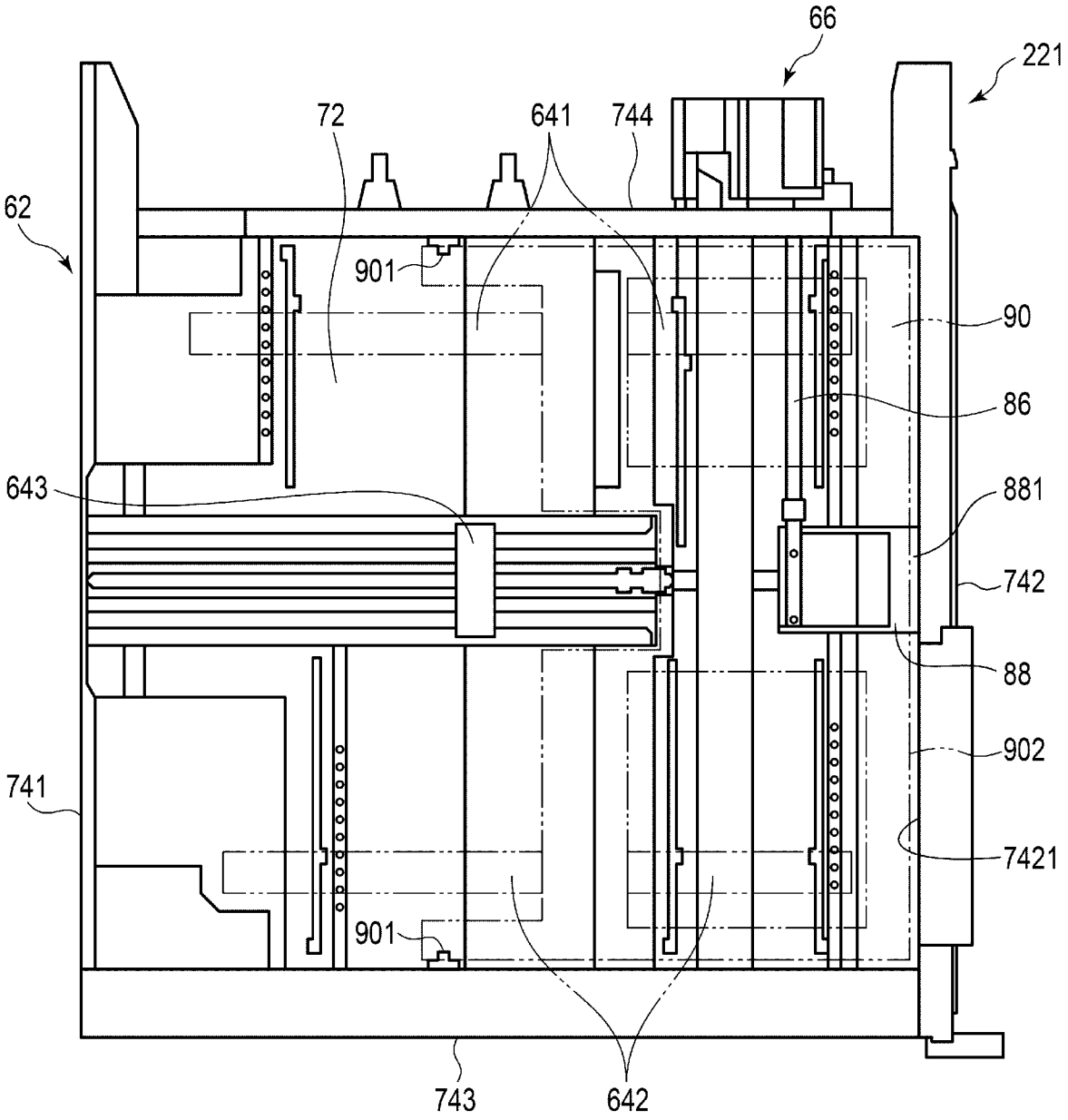
FIG. 7 is a schematic top view showing a sheet feed tray.

FIG. 7 shows a top view of the sheet feed tray 221. An upper side in FIG. 7 is disposed on a back side of the sheet feed tray storage unit 22, and a lower side in FIG. 7 is a handle side from which side the user takes out and pushes in the sheet feed tray 221. As shown in FIG. 7, the sheet feed tray 221 includes the sheet storage portion 62, side fences 641, 642, and 643, and a tray-up mechanism 66. Two-dot chain lines in FIG. 7 show the side fences 641 and 642 and the second rotation plate 90 that operates by the tray-up mechanism 66.

The sheet storage portion 62 is formed in, for example, a box shape that is opened upward. The sheet storage portion 62 includes the sheets placed therein and is attached to and detached from the sheet feed tray storage unit 22. The sheet storage portion 62 includes, for example, a bottom plate 72 having a substantially rectangular shape, and side plates 741, 742, 743, and 744. The side plates 741 and 742 are used as rails when the sheet storage portion 62 of the sheet feed tray 221 is to be pulled out from a predetermined position in the sheet feed tray storage unit 22 or pushed into the predetermined position. The side plate 743 is used as a handle when the user attaches the sheet storage portion 62 of the sheet feed tray 221 to a predetermined position in the main body 12 or detaches the sheet storage portion 62 of the sheet feed tray 221 from the predetermined position. The side plate 744 is disposed on a back surface side when the sheet storage portion 62 of the sheet feed tray 221 is stored at the predetermined position in the main body 12.

The side fences 641 and 642 face each other between the side plates 743 and 744. The side fences 641 and 642 can move along a direction in which the sheet storage portion 62 of the sheet feed tray 221 is pulled out from the predetermined position in the sheet feed tray storage unit 22 or pushed into the predetermined position. Therefore, the side fences 641 and 642 can slide in a direction intersecting with the sheet feed direction from the sheet feed tray 221 to the sheet feed roller 48 (a direction from left to right in FIG. 7), preferably in a direction orthogonal to the sheet feed direction, and the side fences 641 and 642 that face each other move in conjunction with each other. The side fences 641 and 642 that face each other come into contact with both end portions of the sheet, so that the sheet is positioned in the sheet feed tray 221 along the direction in which the sheet storage portion 62 is pulled out or pushed in.

A surface 7421 of the side plate 742 on a side plate 741 side is in contact with an end surface of the sheet. The side fence 643 is brought close to and separated from the surface 7421 of the side plate 742. Therefore, the side fence 643 can move along the sheet feed direction from the sheet feed tray 221 to the sheet feed roller 48 (the direction from left to right in FIG. 7). The side fence 643 and the surface 7421 of the side plate 742 come into contact with both end portions of the sheet, and thus the sheet is positioned in the sheet feed tray 221 along the sheet feed direction.

Figure 8:
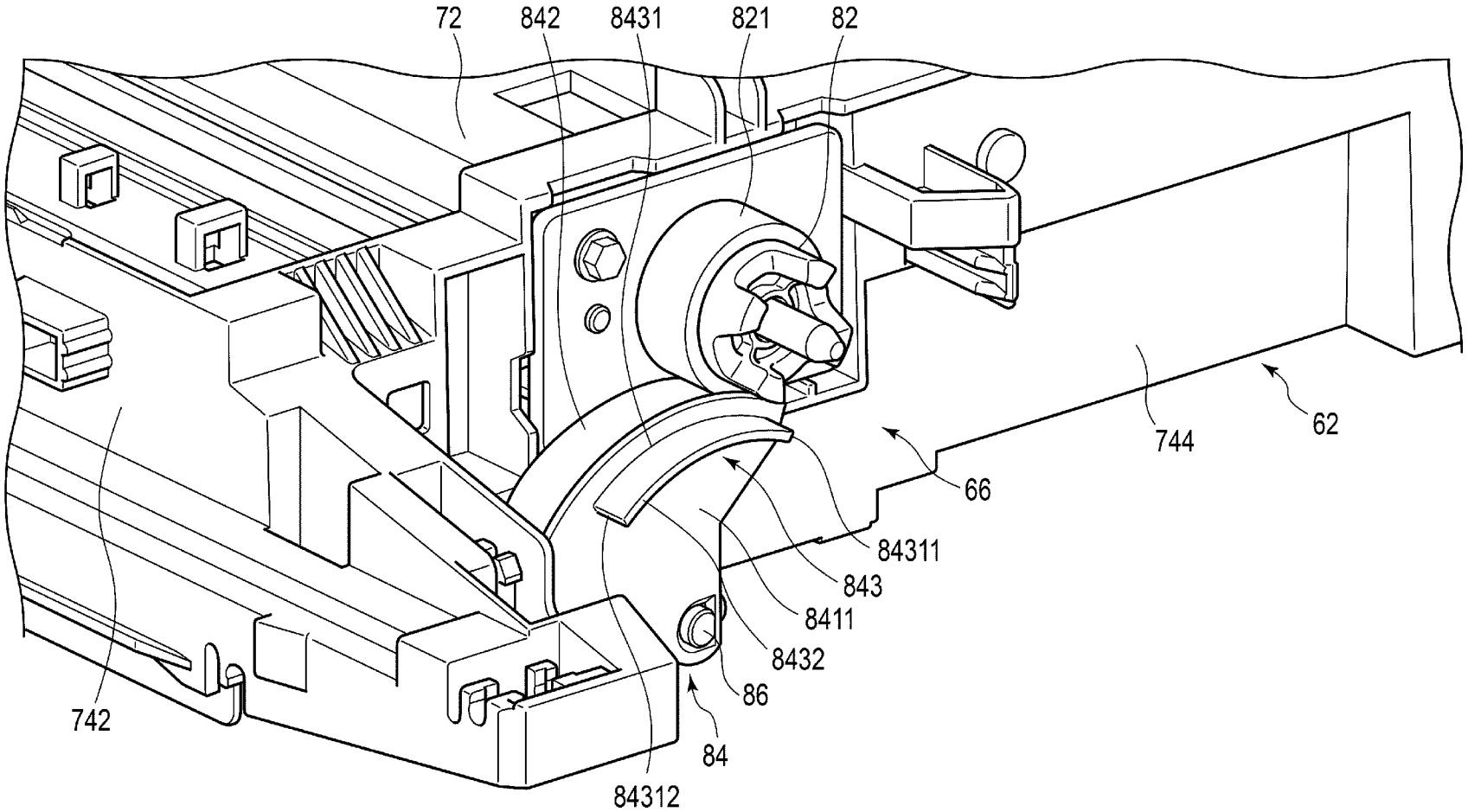
FIG. 8 is a schematic perspective view showing a part of a sheet storage portion and the tray-up mechanism.

FIG. 8 is a perspective view showing the side plate 744 of the sheet storage portion 62, and the second coupling 82 and the tray-up gear 84 of the tray-up mechanism 66 of the sheet feed tray 221.

As shown in FIGS. 4, 7, and 8, the tray-up mechanism 66 includes the second coupling 82, the tray-up gear 84, a tray-up shaft 86, a first rotation plate 88, and the second rotation plate 90.

The second coupling 82 is formed in a cylindrical shape. The second coupling 82 is coupled to the first coupling 442 of the tray driving unit 44 when the sheet feed tray 221 is attached to the sheet feed tray storage unit 22. The first coupling 442 and the second coupling 82 are fitted around the same central axis. Therefore, the second coupling 82 rotates together with the first coupling 442. The second coupling 82 is decoupled from the first coupling 442 of the tray driving unit 44 when the sheet feed tray 221 is detached from the sheet feed tray storage unit 22.

The second coupling 82 includes the outer peripheral gear 821 on an outer peripheral surface thereof. The outer peripheral gear 821 meshes with the tray-up gear 84.

The tray-up gear 84 is formed in, for example, a fan shape. The tray-up gear 84 rotates within a predetermined range due to rotation of the second coupling 82. A rotation axis (central axis) of the tray-up gear 84 is parallel to a rotation axis of the second coupling 82 and a predetermined distance is kept between the rotation axis of the tray-up gear 84 and the rotation axis of the second coupling 82.

As shown in FIGS. 4, 5, and 8, the tray-up gear 84 includes the gear body 841, an outer peripheral gear 842, and the protruding portion 843.

The gear body 841 is formed in, for example, a fan shape, and includes a surface 8411 on a back surface side and a first circular arc portion 8412. The gear body 841 is provided in the sheet storage portion 62. The gear body 841 rotates, when the sheet storage portion 62 is attached to the sheet feed tray storage unit 22, between the first position and a second position with a direction as a rotation axis, and the direction is along the direction in which the sheet storage portion 62 is attached to the sheet feed tray storage unit 22 and the direction in which the sheet storage portion 62 is detached from the sheet feed tray storage unit 22.

The outer peripheral gear 842 is formed on an outer peripheral surface extending from a position of the first circular arc portion 8412 of the gear body 841 toward the front surface side. The outer peripheral gear 842 meshes with the outer peripheral gear 821 of the second coupling 82. Therefore, the gear 84 rotates due to the rotation of the second coupling 82.

The protruding portion 843 protrudes from the surface 8411 of the gear body 841 on the back surface side toward the back surface of the main body 12 of the image forming apparatus 10. The protruding portion 843 moves due to the rotation of the gear body 841 of the tray-up gear 84 between the first position and the second position. The protruding portion 843 includes a second circular arc portion 8431 that has a plate shape and whose central axis is the rotation axis of the gear 84, and a protruding edge portion 8432. The second circular arc portion 8431 includes a first end portion 84311 and a second end portion 84312 in a direction around the rotation axis (central axis) of the gear 84. That is, the protruding portion 843 includes the first end portion 84311 and the second end portion 84312 in a direction intersecting with the protruding direction from the gear body 841. In the protruding portion 843, the protruding edge portion 8432 between the first end portion 84311 and the second end portion 84312 and protruding from the gear body 841 toward the back surface of the main body 12 has a protruding amount that gradually increases from the first end portion 84311 toward the second end portion 84312. In the present embodiment, the protruding edge portion 8432 of the protruding portion 843 is formed in, for example, a straight line shape when the tray-up gear is viewed from above. The protruding portion 843 is disposed at a position that crosses a space between the light emitting unit 521 and the light receiving units 522 of the sheet amount detection sensor 52. The protruding portion 843 is disposed at a position not in contact with the sheet amount detection sensor 52.

A protruding amount Da of the first end portion 84311 of the second circular arc portion 8431 from the surface 8411 of the gear body 841 on the back surface side toward the back surface side of the main body 12 is smaller than a protruding amount Db of the second end portion 84312 of the second circular arc portion 8431 from the surface 8411 of the gear body 841 on the back surface side. The protruding amount of the tray-up gear 84 between the first end portion 84311 and the second end portion 84312 from the surface 8411 of the gear body 841 toward the back surface of the main body 12 of the image forming apparatus 10 (a protruding amount in a direction along the rotation axis of the tray-up gear 84) gradually increases from the first end portion 84311 toward the second end portion 84312. Therefore, a protruding amount Dc between the second circular arc portion 8431 and the protruding edge portion 8432 at any position between the first end portion 84311 and the second end portion 84312 is larger than the protruding amount Da and smaller than the protruding amount Db.

Figure 9:
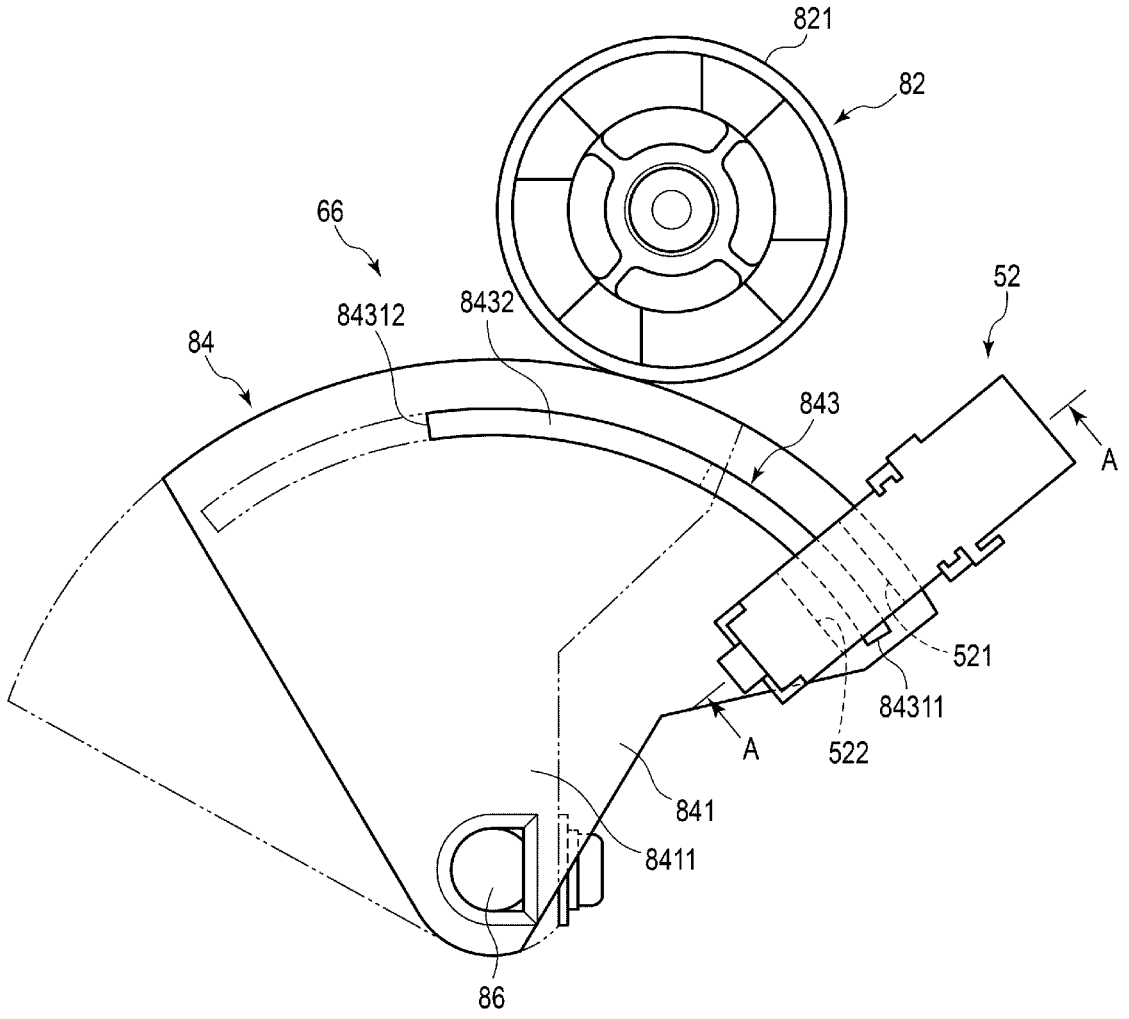
FIG. 9 is a schematic view showing a positional relationship between the sheet amount detection sensor on the main body side, and a second coupling and the tray-up gear on the sheet feed tray side, as viewed from a back surface side of the main body.
Figure 10:
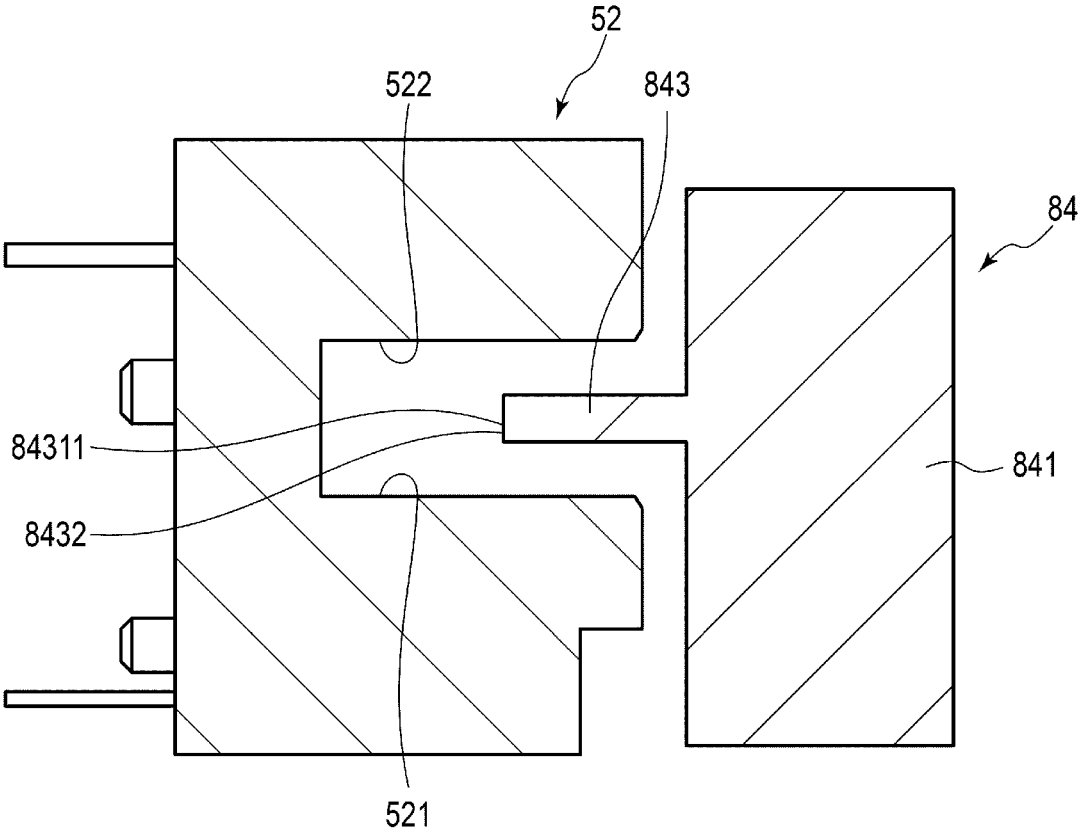
FIG. 10 is a schematic cross-sectional view showing a positional relationship between a protruding portion of the tray-up gear at a position along line A-A in FIG. 9 and the sheet amount detection sensor on the main body side.
Figure 11:
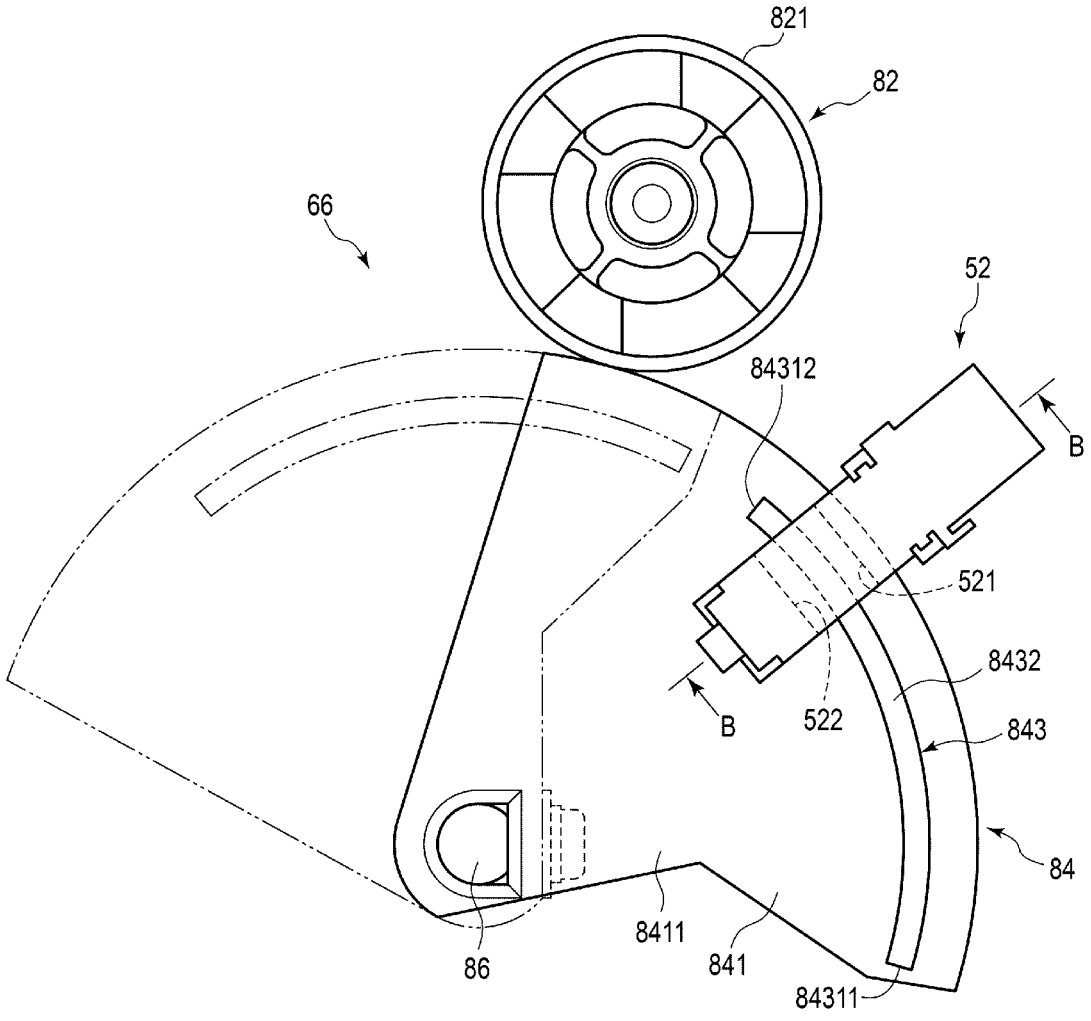
FIG. 11 is a schematic view showing a positional relationship between the sheet amount detection sensor on the main body side, and the second coupling and the tray-up gear on the sheet feed tray side, as viewed from the back surface side of the main body.
Figure 12:
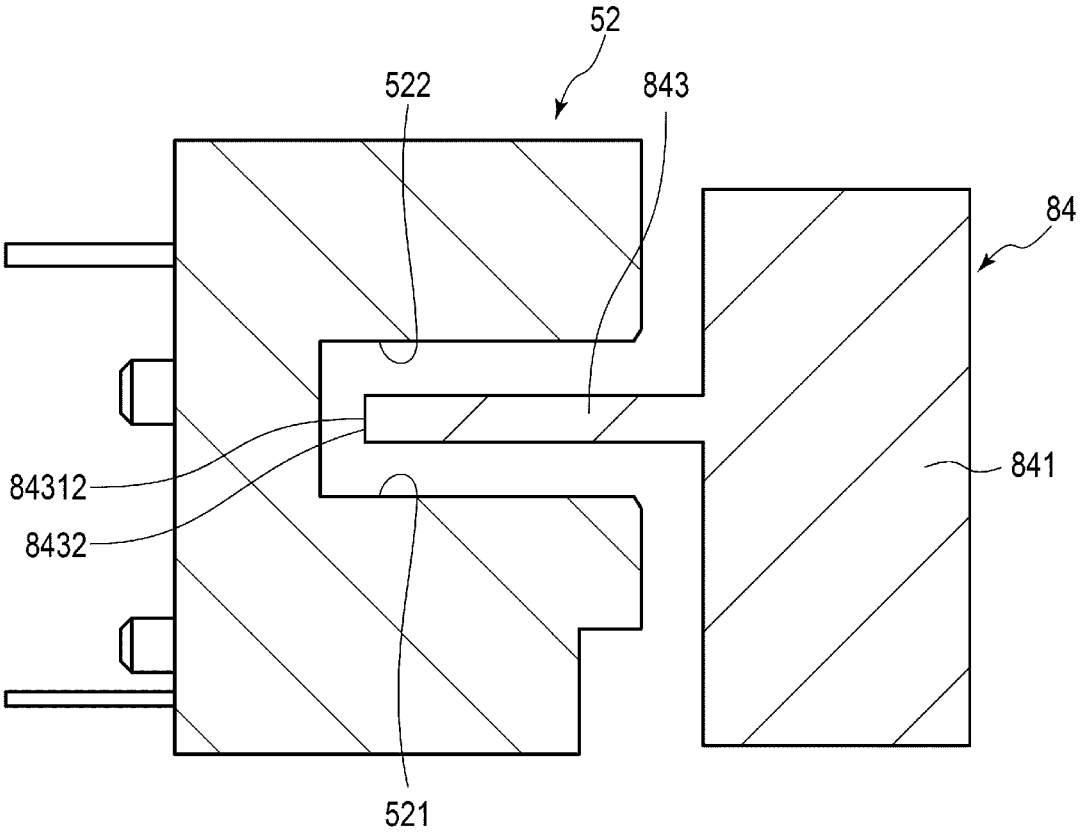
FIG. 12 is a schematic cross-sectional view showing a positional relationship between the protruding portion of the tray-up gear at a position along line B-B in FIG. 11 and the sheet amount detection sensor on the main body side.
Figure 13:
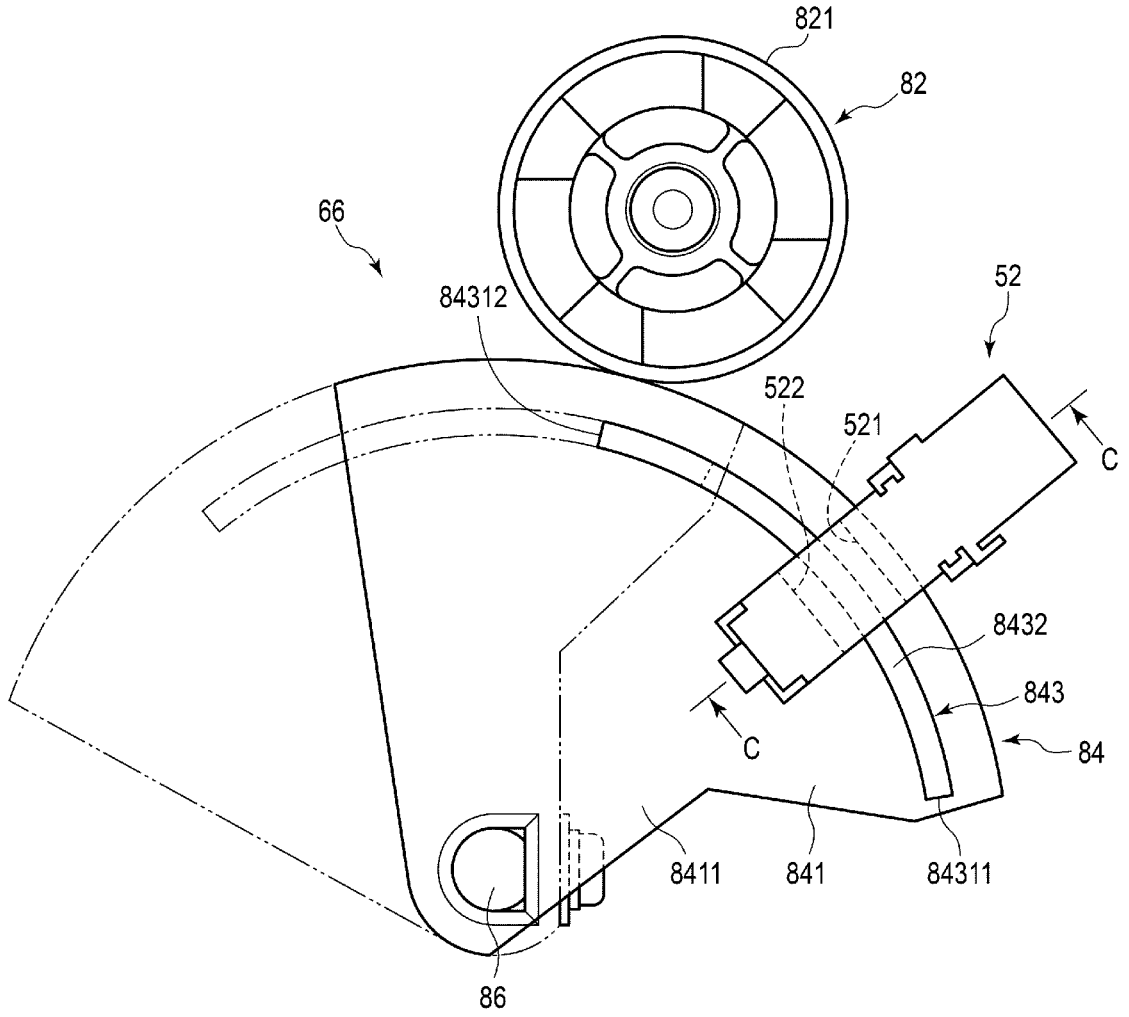
FIG. 13 is a schematic view showing a positional relationship between the sheet amount detection sensor on the main body side, and the second coupling and the tray-up gear on the sheet feed tray side, as viewed from the back surface side of the main body.
Figure 14:
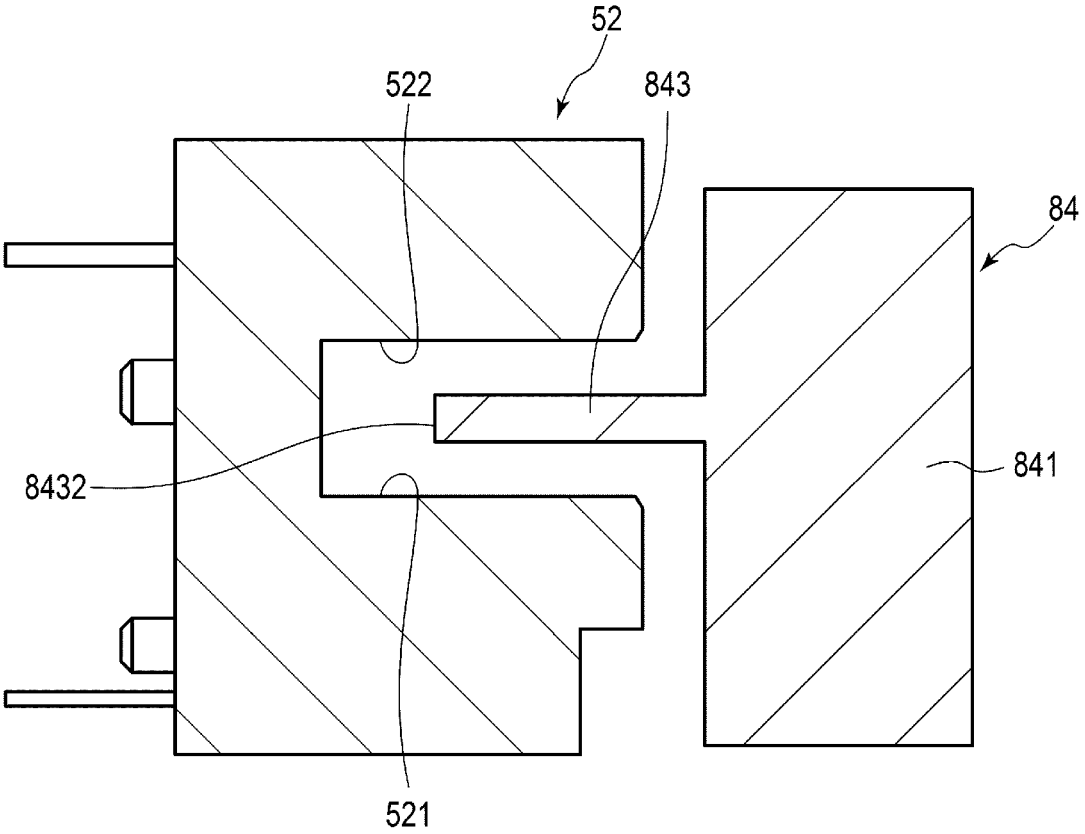
FIG. 14 is a schematic cross-sectional view showing a positional relationship between the protruding portion of the tray-up gear at a position along line C-C in FIG. 13 and the sheet amount detection sensor on the main body side.

FIGS. 9 to 14 show the protruding portion 843 of the tray-up gear 84, and the light emitting unit 521 and the light receiving units 522 of the sheet amount detection sensor 52. A two-dot chain line in FIG. 9 shows a state where the gear body 841 is in the first position. A solid line in FIG. 9 and FIG. 10 show a state where a vicinity of the first end portion 84311 of the protruding portion 843 of the tray-up gear 84 enters between the light emitting unit 521 and the light receiving units 522 of the sheet amount detection sensor 52 and blocks a part of the light receiving units 522. FIG. 10 shows a cross section taken along line A-A in FIG. 9. A two-dot chain line in FIG. 11 shows a state where the gear body 841 is in the first position. A solid line in FIG. 11 and FIG. 12 show a state where a vicinity of the second end portion 84312 of the protruding portion 843 of the tray-up gear 84 enters the space between the light emitting unit 521 and the light receiving units 522 of the sheet amount detection sensor 52 and blocks a part of the light received by the light receiving units 522. FIG. 12 shows a cross section taken along line B-B in FIG. 11. A two-dot chain line in FIG. 13 shows a state where the gear body 841 is in the first position. A solid line in FIG. 13 and FIG. 14 show a state where a portion between the first end portion 84311 and the second end portion 84312 of the protruding portion 843 of the tray-up gear 84 enters between the light emitting unit 521 and the light receiving units 522 of the sheet amount detection sensor 52 and blocks a part of the light received by the light receiving units 522. FIG. 14 shows a cross section taken along line C-C in FIG. 13.

In an example shown in FIG. 10, the protruding portion 843 blocks a part of the light from the light emitting unit 521. Therefore, most (for example, nineteen) of the plurality of light receiving units 522 receive the light from the light emitting unit 521, but for example, one light receiving unit 522 does not receive the light from the light emitting unit 521.

In an example shown in FIG. 12, the protruding portion 843 blocks most of the light from the light emitting unit 521. Therefore, a part of the plurality of light receiving units 522 (for example, four light receiving units 522) receives the light from the light emitting unit 521, but for example, the remaining sixteen light receiving units 522 among the twenty light receiving units 522 do not receive the light from the light emitting unit 521.

In an example shown in FIG. 14, the protruding portion 843 blocks substantially half of the light from the light emitting unit 521. Therefore, a part of the plurality of light receiving units 522 (for example, twelve light receiving units 522) receives the light from the light emitting unit 521, but for example, the remaining eight light emitting units 522 among the twenty light receiving units 522 do not receive the light from the light emitting unit 521.

Therefore, as the gear body 841 moves from the first position to the second position, the protruding portion 843 is interposed in the space between the light emitting unit 521 and the plurality of light receiving units 522 of the sheet amount detection sensor 52. As a result, the number of light receiving units 522 that receive the light among the plurality of light receiving units 522 is increased or decreased, and the output signal increase or decreases according to the number of light receiving units 522 that receive the light. Therefore, the sheet amount detection sensor 52 outputs the output signal according to the positional relationship between the sheet amount detection sensor 52 and the protruding portion 843 of the tray-up gear 84.

The tray-up shaft 86 is fixed to a position of the central axis of the tray-up gear 84. The tray-up shaft 86 penetrates the side plate 744 and extends toward the side plate 743. The tray-up shaft 86 rotates due to the rotation of the tray-up gear 84. The tray-up shaft 86 is prevented from protruding upward from the bottom plate 72 by, for example, a recess of the bottom plate 72.

The first rotation plate 88 is formed in a plate shape and fixed to the tray-up shaft 86. The first rotation plate 88 rotates due to rotation of the tray-up shaft 86. An end portion 881 of the first rotation plate 88 on the downstream side in the sheet feed direction is raised and lowered with respect to the bottom plate 72 due to the rotation of the tray-up shaft 86.

The second rotation plate 90 is provided in the sheet storage portion 62. The second rotation plate 90 includes rotation shafts 901 each extending in a direction that is parallel to an extending direction of the tray-up shaft 86 and is along the attachment direction and the detachment direction of the sheet feed tray 221 with respect to the sheet feed tray storage unit 22. The rotation shafts 901 are formed on a side opposite to the downstream side in the sheet feed direction with respect to the tray-up shaft 86. The second rotation plate 90 is located above the first rotation plate 88. The sheet is placed on an upper side of the second rotation plate 90. The end portion 902 of the second rotation plate 90 on the downstream side in the sheet feed direction is raised and lowered due to rising and lowering of the end portion 881 of the first rotation plate 88 on the downstream side in the sheet feed direction. Therefore, when the end portion 881 of the first rotation plate 88 on the downstream side in the sheet feed direction is raised, the end portion 902 of the second rotation plate 90 on the downstream side in the sheet feed direction is raised, and the sheet is raised. The sheet feed roller 48 is located above the sheet feed tray 221 on the downstream side in the sheet feed direction. When the end portion 881 of the first rotation plate 88 on the downstream side in the sheet feed direction is lowered, the end portion 902 of the second rotation plate 90 on the downstream side in the sheet feed direction is lowered.

When the gear body 841 is in the first position, the end portion 902 of the second rotation plate 90 on a sheet feed roller 48 side on the downstream side in the sheet feed direction is disposed at a position in contact with or closest to the bottom plate 72 of the sheet storage portion 62. When the gear body 841 is in the second position, the end portion 902 of the second rotation plate 90 on the downstream side in the sheet feed direction is disposed at a position farthest from the bottom plate 72 of the sheet storage portion 62. Thus, the end portion 902 of the second rotation plate 90 on the downstream side in the sheet feed direction is raised with respect to the bottom plate 72 according to a rotation amount of the gear body 841.

When the sheet feed tray 221 is inserted into the sheet feed tray storage unit 22 and the second rotation plate 90 of the sheet feed tray 221 is raised by the tray-up mechanism 66, the sheet feed roller 48 is pushed upward by the sheet on the second rotation plate 90. That is, the second rotation plate 90 operates due to rotation of the gear body 841 when the sheet storage portion 62 is attached to the sheet feed tray storage unit 22 so as to bring the sheets placed in the sheet storage portion 62 into contact with the sheet feed roller 48.

The control unit 26 converts the output signal of the sheet amount detection sensor 52 into the remaining amount of sheets and outputs the remaining amount of sheets to the control panel 18.

The control unit 26 loads, into a RAM, a control program stored in a memory such as a ROM by, for example, a processor such as one or more CPUs, to execute appropriate processing on the conveying unit 14, the printer 16, the control panel 18, the scanner 20, and the sheet feed tray storage unit 22. Alternatively, the control unit 26 reads a program via a network by, for example, a processor such as one or more CPUs, to execute the appropriate processing on the conveying unit 14, the printer 16, the control panel 18, the scanner 20, and the sheet feed tray storage unit 22. The control unit 26 can control the conveying unit 14, the printer 16, the control panel 18, the scanner 20, and the sheet feed tray storage unit 22 by a circuit (for example, ASIC) that realizes one or more functions.

Figure 15:
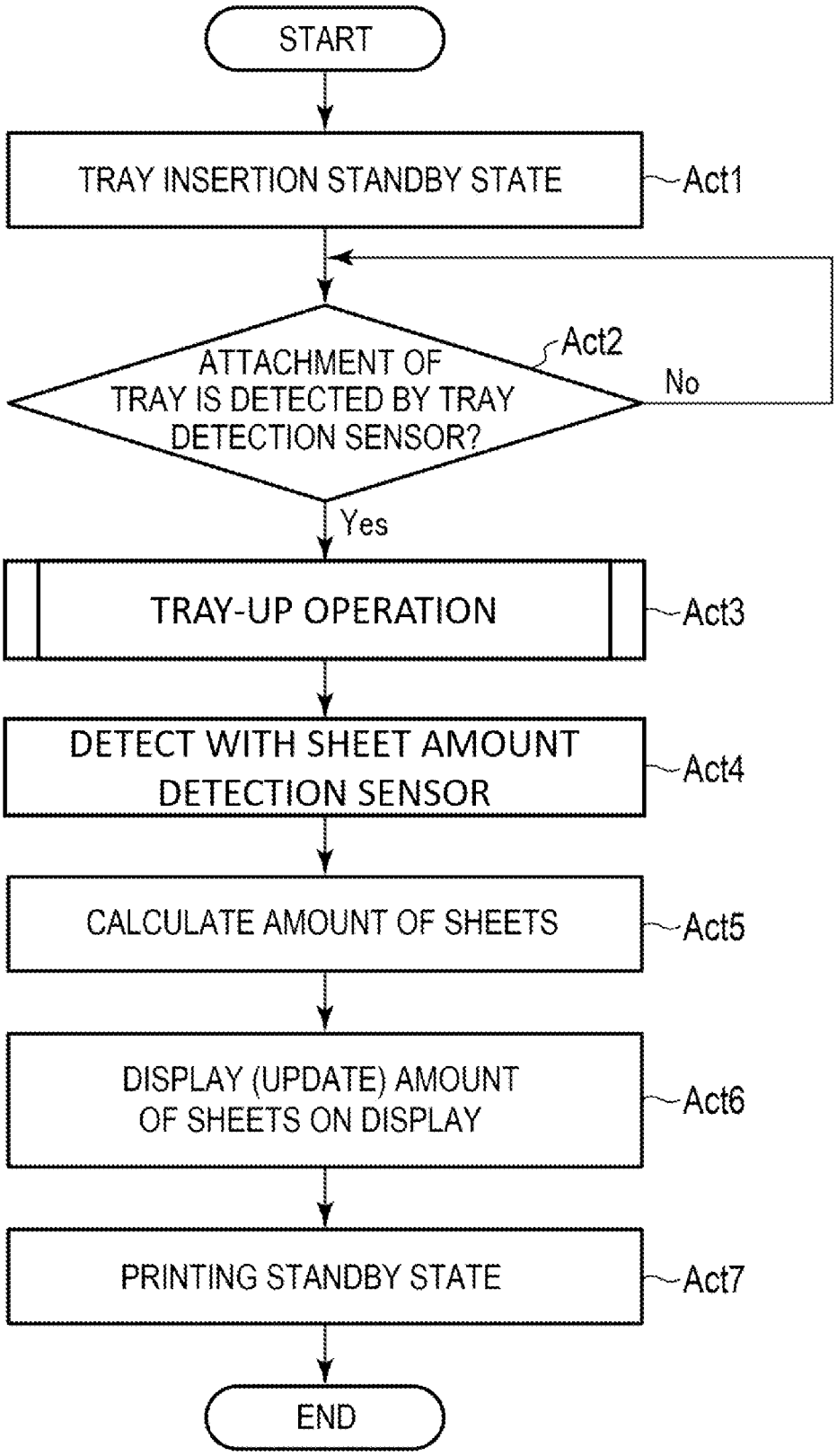
FIG. 15 is a flow diagram of a process related to displaying of a remaining amount of sheets in the sheet feed tray.
Figure 16:
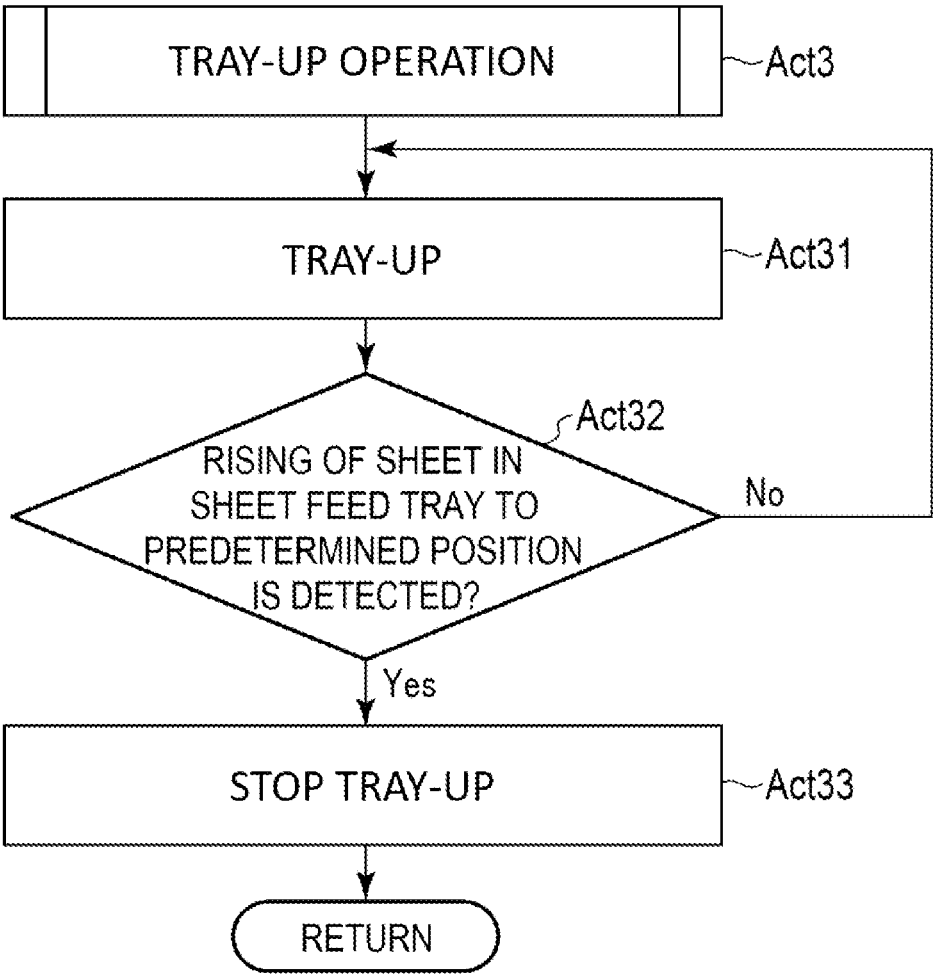
FIG. 16 is a flow diagram of a process related to a tray-up operation in FIG. 15.

The control unit 26 of the image forming apparatus 10 operates processing related to displaying of the remaining amount of sheets in the sheet feed tray 221 according to, for example, flowcharts shown in FIG. 15 and FIG. 16.

As shown in FIG. 15, for example, when a power supply of the main body 12 of the image forming apparatus is switched to ON, the control unit 26 sets tray detection performed by the tray detection sensor 42 of the sheet feed tray storage unit 22 to a standby state (Act 1). After the image forming apparatus 10 performs printing, the control unit 26 also sets the tray detection performed by the tray detection sensor 42 to the standby state.

The control unit 26 determines whether the sheet feed tray 221 is in an attached position or a detached position with respect to the sheet feed tray storage unit 22 by using a signal of the tray detection sensor 42 (Act 2). If the tray detection sensor 42 cannot detect that the sheet feed tray 221 is attached to the sheet feed tray storage unit 22 (No in Act 2), the control unit 26 continues the processing until the tray detection sensor 42 detects that the sheet feed tray 221 is attached to the sheet feed tray storage unit 22.

If the tray detection sensor 42 can detect that the sheet feed tray 221 is attached to the sheet feed tray storage unit 22 (Yes in Act 2), the control unit 26 causes the tray-up mechanism 66 to operate (Act 3).

As shown in FIG. 16, the control unit 26 drives the motor 441 of the tray driving unit 44 to rotate the second coupling 82 on the sheet feed tray 221 side coupled to the first coupling 442. Due to the rotation of the second coupling 82, the tray-up gear 84 rotates. At this time, the tray-up shaft 86 rotates due to the rotation of the tray-up gear 84, and the end portion 881 of the first rotation plate 88 on the downstream side in the sheet feed direction is raised with respect to the bottom plate 72. Therefore, the second rotation plate 90 rotates about the rotation shafts 901, and the end portion 902 of the second rotation plate 90 on the downstream side in the sheet feed direction is raised and separated from the bottom plate 72 (Act 31).

The control unit 26 uses the tray-up sensor 50 to determine whether or not the sheet on the second rotation plate 90 is raised to a predetermined position in contact with the sheet feed roller 48 (Act 32).

If the sheet on the second rotation plate 90 is not raised to the predetermined position in contact with the sheet feed roller 48 (No in Act 32), the control unit drives the motor 441 to further rotate the second coupling 82 on the sheet feed tray 221 side coupled to the first coupling 442. Therefore, the control unit 26 drives the motor 441 to further raise the end portion 902 of the second rotation plate 90 on the downstream side in the sheet feed direction.

If the control unit 26 determines, by using the tray-up sensor 50, that the sheet on the second rotation plate 90 is raised to the predetermined position in contact with the sheet feed roller 48 (Yes in Act 32), the control unit 26 stops the operation of the motor 441. The control unit 26 continues to control the motor 441 and maintains the position of the end portion 902 of the second rotation plate 90, on the downstream side in the sheet feed direction, with respect to the bottom plate 72 (Act 33).

As shown in FIG. 15, when the operation of the motor 441 is stopped, the control unit 26 detects the output voltage of the sheet amount detection sensor 52 (Act 4). The sheet amount detection sensor 52 changes the output signal according to the number of light receiving units 522 that receive light among the twenty light receiving units 522, for example. For example, when a predetermined maximum amount of sheets is placed on the sheet feed tray 221, the tray-up gear 84 rotates from the first position shown by the two-dot chain line in FIG. 9 to the position shown by the solid line in FIG. 9 at which position the sheets come into contact with the sheet feed roller 48. As shown in FIGS. 9 and 10, for example, one light receiving unit 522 is shielded, and the remaining nineteen light receiving units 522 receive the light from the light emitting unit 521. In this case, the sheet amount detection sensor 52 outputs an output signal of 2.9 V.

The control unit 26 calculates the remaining amount of sheets in the sheet feed tray 221 based on the output signal from the sheet amount detection sensor 52 (Act 5). The remaining amount of sheets based on the output signal of the sheet amount detection sensor 52 is output, for example, based on the sheet amount calculation data table 28 shown in FIG. 3.

As shown in FIGS. 9 and 10, when the vicinity of the first end portion 84311 of the protruding portion 843 is interposed between the light emitting unit 521 and the light receiving units 522, for example, light reception by one light receiving unit 522 is blocked, and nineteen light receiving units 522 receive the light from the light emitting unit 521. As shown in FIGS. 13 and 14, when a substantially central portion between the first end portion 84311 and the second end portion 84312 of the protruding portion 843 is interposed between the light emitting unit 521 and the light receiving units 522, for example, light reception by eight light receiving units 522 is blocked, and twelve light receiving units 522 receive the light from the light emitting unit 521. As shown in FIGS. 11 and 12, when the vicinity of the second end portion 84312 of the protruding portion 843 is interposed between the light emitting unit 521 and the light receiving units 522, for example, light reception by sixteen light receiving units 522 is blocked, and four light receiving units 522 receive the light from the light emitting unit 521.

Therefore, when the remaining amount of sheets decreases from a fully loaded state in which the remaining amount of sheets is a predetermined amount or less to when the sheets run out, the output signal from the sheet amount detection sensor 52 decreases, for example, stepwise by 0.1 V. When the protruding portion 843 blocks the light reception by up to N (N is a natural number) light receiving units 522 in a positional relationship between the light receiving units 522 and the light emitting unit 521 of the sheet amount detection sensor 52, the remaining amount of sheets is determined to be one of N amounts.

The control unit 26 calculates, based on the output of the sheet amount detection sensor 52, the amount of sheets as, for example, the relative amount (Act 5). That is, the control unit 26 converts the output of the sheet amount detection sensor 52 into the amount of sheets. In the present embodiment, for example, up to sixteen light receiving units 522 are shielded, so that the remaining amount of sheets is determined to be one of 16 amounts.

The control unit 26 displays the remaining amount of sheets on the display 181 (Act 6). In displaying of the remaining amount of sheets, for example, as horizontal bars, and the sheets decrease, the remaining amount of sheets may be displayed as an icon from which the upper bars are removed in order from the uppermost bar, or the remaining amount of sheets may be displayed as a relative numerical value such as a percentage, such that 100% is displayed when the sheets are fully loaded, and 0% is displayed when no sheet is present.

Then, the control unit 26 sets the image forming apparatus 10 to a printing standby state (Act 7).

Thereafter, the control unit 26 ends the processing related to displaying of the remaining amount of sheets.

The control unit 26 according to the present embodiment executes flows shown in FIG. 15 and FIG. 16, for example, after printing once, and after detachment and re-attachment of the sheet feed tray 221 with respect to the sheet feed tray storage unit 22. That is, the control unit 26 drives the motor 441 to adjust a positional relationship between the sheet feed roller 48 and the sheet. Therefore, the positional relationship between the protruding edge portion 8432 of the protruding portion 843 of the tray-up gear 84 and the sheet amount detection sensor 52 is adjusted according to the rotation of the motor 441. Therefore, as described above, the control unit 26 updates the remaining amount of sheets displayed on the display 181.

A rotation position of the tray-up gear 84 according to the present embodiment changes according to the amount of sheets placed in the sheet feed tray 221. When the amount of sheets is 100% or close to 100%, a rotation angle of the tray-up gear 84 is an angle by which the tray-up gear 84 moves from the first position shown by the two-dot chain line to the position shown by the solid line in FIG. 9. When the amount of sheets is 0% or close to 0%, the rotation angle of the tray-up gear 84 is an angle by which the tray-up gear 84 moves from the first position shown by the two-dot chain line to the second position shown by the solid line in FIG. 11. The remaining amount of sheets between 0% and 100% can be indicated according to the number of light receiving units 522, that is, a resolution of the sheet amount detection sensor 52. That is, the sheet amount detection sensor 52 increases the output signal as the number of light receiving units 522 that are detected as receiving light among the plurality of light receiving units 522 increases. The sheet amount detection sensor 52 outputs the output signal at a particular level corresponding to the resolution corresponding to the number of light receiving units 522.

When the sheets are fully loaded up to 100% in the sheet feed tray 221, as shown in FIGS. 9 and 10, the first rotation plate 88 and the second rotation plate 90 rotate by a predetermined minimum angle from the first position in order to bring the sheets into contact with the sheet feed roller 48. At this time, the first end portion 84311 of the protruding portion 843 and the vicinity of the first end portion 84311 shield one light receiving unit 522 among the twenty light receiving units 522, for example. Therefore, among the twenty light receiving units 522, the remaining nineteen light receiving units 522 receive the light from the light emitting unit 521. At this time, the control unit 26 detects, for example, an output of 2.9 V from the sheet amount detection sensor 52.

When there is no sheet in the sheet feed tray 221, as shown in FIGS. 11 and 12, the first rotation plate 88 and the second rotation plate 90 rotate by a maximum angle from the first position in order to bring the sheets into contact with the sheet feed roller 48. At this time, the protruding portion 843 blocks, for example, sixteen light receiving units 522 among the twenty light receiving units 522. Therefore, among the twenty light receiving units 522, the remaining four light receiving units 522 receive the light from the light emitting unit 521. At this time, the control unit 26 detects, for example, an output of 1.4 V from the sheet amount detection sensor 52.

Thus, in the image forming apparatus 10 according to the present embodiment, the number of light receiving units 522 shielded by the protruding portion 843 changes according to the position of the end portion 902 of the second rotation plate 90 on the downstream side in the sheet feed direction. The output of the sheet amount detection sensor 52 changes according to the number of light receiving units 522 that are shielded. The control unit calculates, based on the output of the sheet amount detection sensor 52, the amount of sheets as, for example, the relative amount. At this time, the output signal level of the sheet amount detection sensor 52 can be set according to the resolution of the sheet amount detection sensor 52. Therefore, the control unit 26 can output the remaining amount of sheets at a particular level corresponding to the resolution of the sheet amount detection sensor 52. Therefore, if the sheet amount detection sensor 52 has an appropriate resolution, the user can easily grasp, by viewing, for example, the display 181 of the control panel 18, how many sheets are loaded, for example, when a large amount of printing is to be performed using the image forming apparatus 10 or when the sheets are to be replenished.

According to the present embodiment, the image forming apparatus 10 capable of outputting the remaining amount of sheets stored in the sheet feed tray 221 with higher accuracy can be provided.

A part of the protruding portion 843 of the tray-up gear 84 may be disposed in advance so as to block light reception by one light receiving unit 522 between the light emitting unit 521 and the light receiving units 522 of the sheet amount detection sensor 52 when the gear body 841 is in the first position. The control unit 26 can detect the amount of sheets by using, as a trigger, a signal generated by the light reception performed by one light receiving unit 522 of the sheet amount detection sensor 52.

A part of the protruding portion 843 of the tray-up gear 84 may be disposed so that at least one light receiving unit 522 between the light emitting unit 521 and the light receiving unit 522 of the sheet amount detection sensor 52 can receive light when the gear body 841 is in the second position as shown in FIG. 11.

Figure 17:
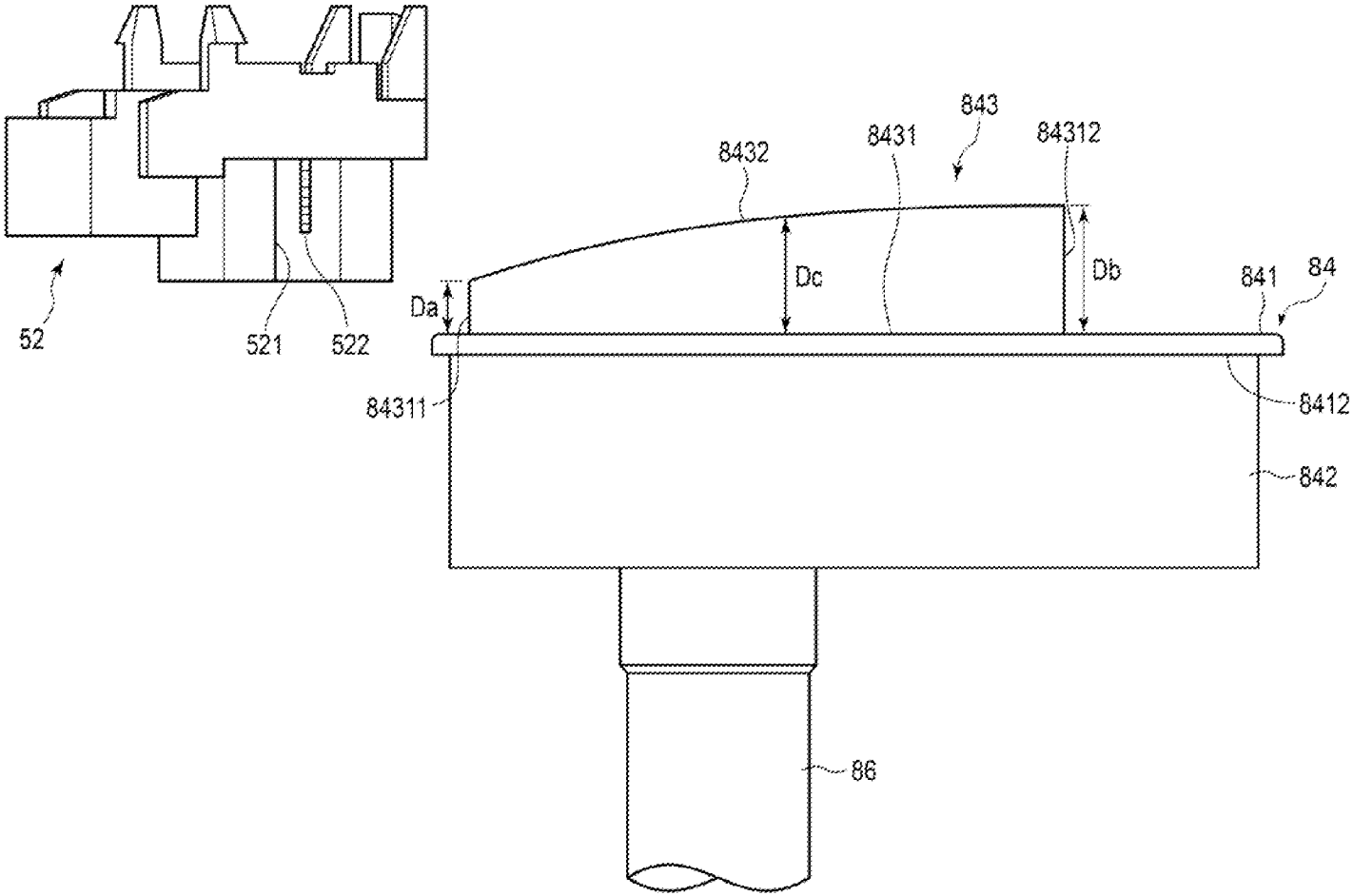
FIG. 17 is a schematic view of the sheet amount detection sensor on a main body side and a modified tray-up gear on a sheet feed tray side of the image forming apparatus, as viewed from above.
Figure 18:
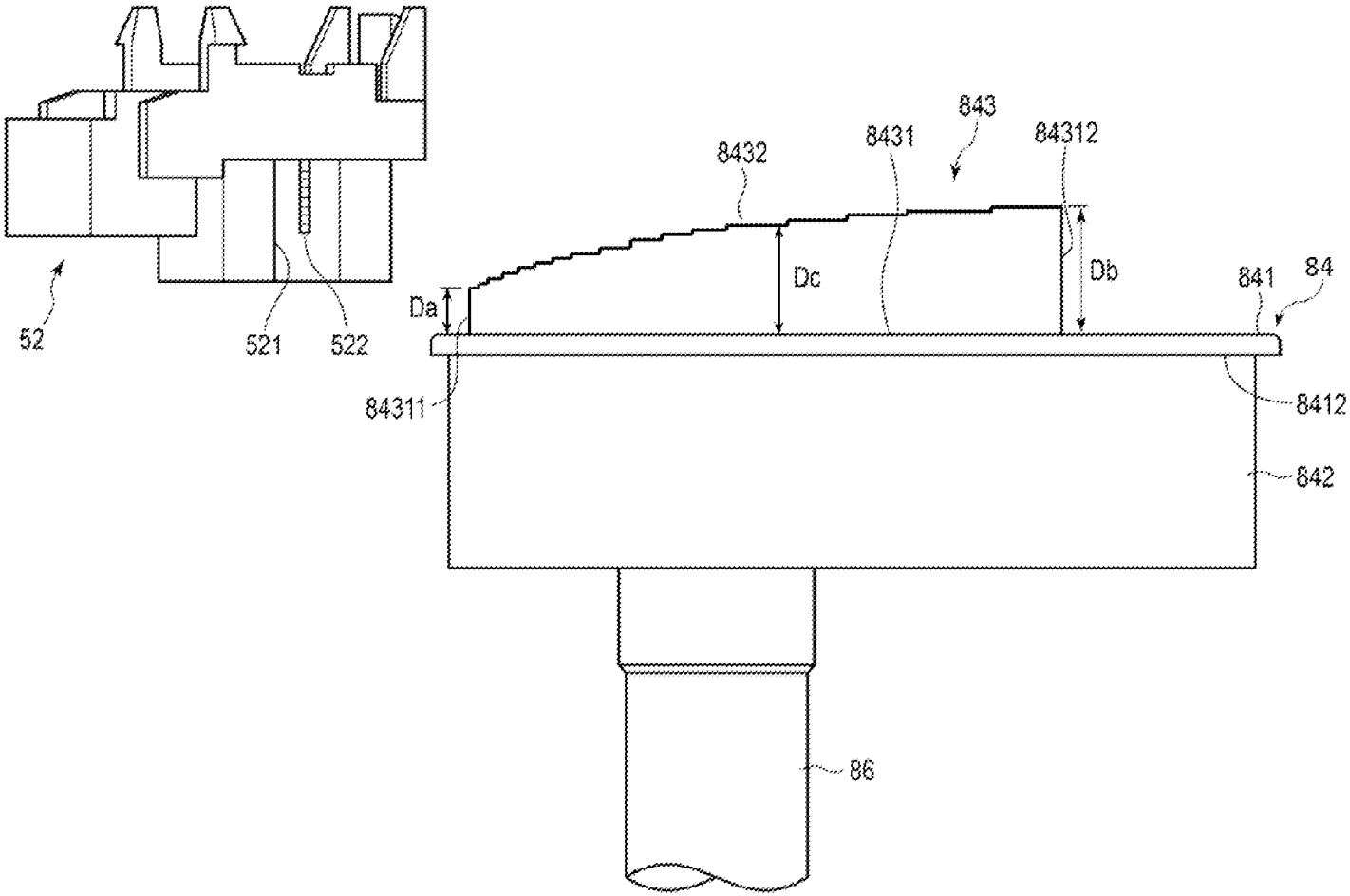
FIG. 18 is a schematic view of the sheet amount detection sensor on a main body side and a modified tray-up gear on a sheet feed tray side of the image forming apparatus, as viewed from above.

An example is described in which the protruding edge portion 8432 of the protruding portion 843 is formed to be a straight line when the tray-up gear 84 is viewed from above as shown in FIG. 5. As shown in FIG. 17, the protruding edge portion 8432 of the protruding portion 843 may be formed to be a curved line when the tray-up gear 84 is viewed from above. Further, As shown in FIG. 18, the protruding edge portion 8432 of the protruding portion 843 may be formed in a stepped shape.

In the protruding portion 843 described in the present embodiment, the protruding amount Da of the first end portion 84311 from the surface 8411 of the gear body 841 on the back surface side toward the back surface side of the main body 12 is smaller than the protruding amount Db of the second end portion 84312 from the surface 8411 of the gear body 841 on the back surface side toward the back surface side of the main body 12. As the protruding portion 843, for example, it is also preferable that the protruding amount Da of the first end portion 84311 is larger than the protruding amount Db of the second end portion 84312. In this case, when the protruding portion 843 blocks a part of the light receiving units 522 by the first end portion 84311, the output signal level from the sheet amount detection sensor 52 is the smallest. Then, as the gear body 841 rotates from the first position to the second position, the output signal level from the sheet amount detection sensor 52 increases.

The sheet amount detection sensor 52 described in the present embodiment increases the output signal level as the number of light receiving units 522 that receive light increases. As the sheet amount detection sensor 52, for example, a sensor that decreases the output signal level as the number of light receiving units 522 that receive light increases may be used.

The number of light receiving units 522 and the number of different amounts of sheets are examples. For example, the number of different amounts can be appropriately set, for example, at an interval of 5% or 10%, depending on a relationship between the number of light receiving units 522 and the number of light receiving units 522 shielded by using the protruding portion 843.

The sheet amount detection sensor 52 described in the present embodiment is a transmission type sensor. In a transmission type sensor, a light emitting unit and a light receiving unit face each other. A transmission type sensor emits light from a light emitting unit toward a light receiving unit, and detects an object by blocking the light, for example. The sheet amount detection sensor 52 may be another type of sensor other than the transmission type sensor. Other types of sensors include, for example, reflective-type sensors and diffuse reflective-type sensors.

Figure 19:
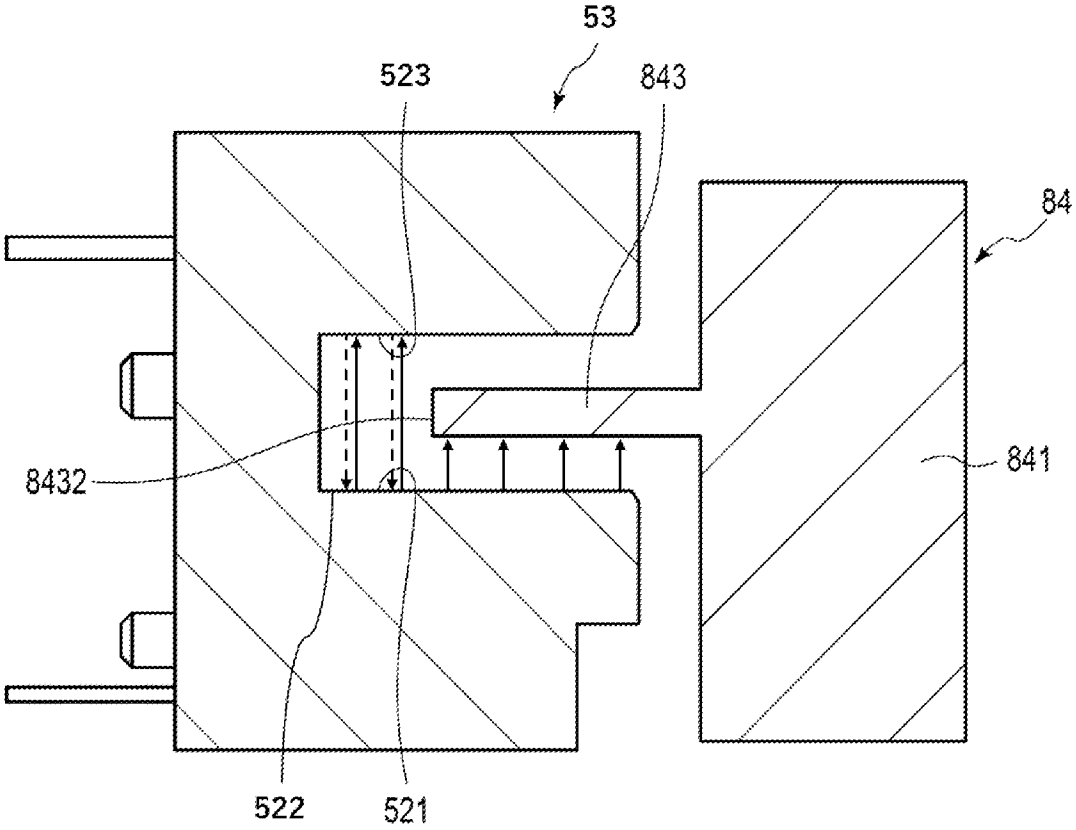
FIG. 19 is a schematic cross-sectional view showing the positional relationship between the projecting portion of the tray-up gear and the sheet amount detecting sensor on the main body side replaced with a reflection-type sensor at the position along the line C-C in FIG. 13, and the positional relationship between the light emitting unit, the light receiving unit and the reflection unit.

A sheet amount detection sensor 53 which is a reflection-type sensor will be described. FIG. 19 shows an example of the sheet amount detection sensor 53, a light path of light emitted from the light emitting unit 521, and a light path of light reflected by the reflecting unit 523. A light path of light emitted from the light emitting unit 521 is indicated by a solid line arrow. A light path of the light reflected by the reflecting unit 523 is indicated by a broken line arrow. Each portion of the sheet amount detection sensor 53, which will be described in the same manner as the sheet amount detection sensor 52, is assigned the same number as each portion of the sheet amount detection sensor 52. The sheet amount detection sensor 53 has a light emitting unit 521, a plurality of light receiving unit 522 on the same plane as the light emitting unit 521, and a reflecting unit 523 opposed to the light emitting unit 521 and the light receiving unit 522. The reflecting unit 523 reflects the light emitted from the light emitting unit 521 toward the light receiving unit 522.

Figure 20:
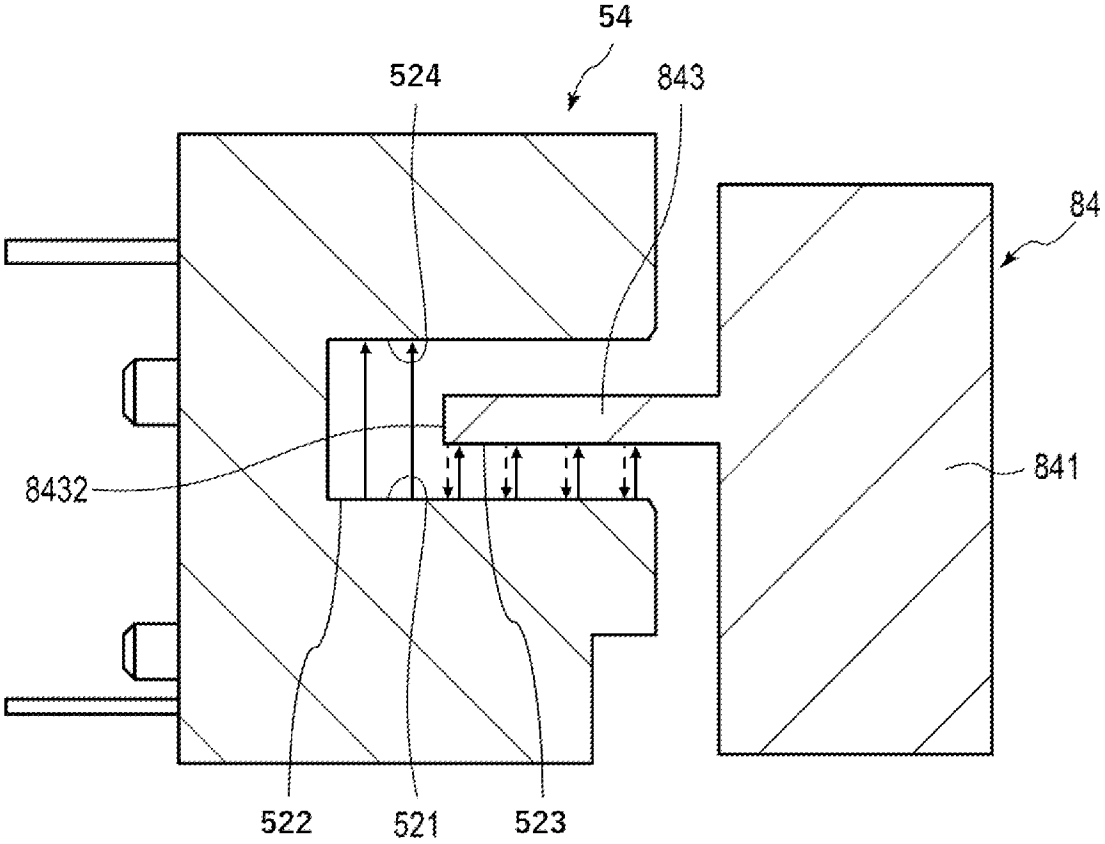
FIG. 20 is a schematic cross-sectional view showing the positional relationship between the projecting portion of the tray-up gear and the sheet amount detecting sensor on the main body side replaced with a diffuse reflection-type sensor at the position along the line C-C in FIG. 13, and the positional relationship between the light emitting unit, the light receiving unit and the reflection unit.

A sheet amount detection sensor 54 which is a diffuse reflection-type sensor will be described. FIG. 20 shows an example of the sheet amount detection sensor 54, a light path of light emitted from the light emitting unit 521, and a light path of light reflected by the reflecting unit 523. A light path of light emitted from the light emitting unit 521 is indicated by a solid arrow. A light path of the light reflected by the reflecting unit 523 is indicated by a dashed line arrow. Each portion of the sheet amount detection sensor 54, which will be described in the same manner as the sheet amount detection sensor 52, is assigned the same number as each portion of the sheet amount detection sensor 52. The sheet amount detection sensor 54 has a light emitting unit 521 and a plurality of light receiving unit 522 on the same plane as the light emitting unit 521. The surface 524 facing the light emitting unit 521 and the light receiving unit 522 does not reflect the light emitted from the light emitting unit 521. When the sheet amount detection sensor 54 is used, the protruding portion 843 of the gear body 84 has a reflecting portion 523. The reflecting portion 523 of the protruding portion 843 reflects light emitted from the light emitting portion 521 toward the light receiving unit 522.

According to the image forming apparatus 10 of at least one embodiment described above, the remaining amount of sheets stored in the sheet feed tray 221 can be output with higher accuracy.

While certain embodiments have been described, these embodiments have been presented by way of example only, and are not intended to limit the scope of the disclosure. Indeed, the novel embodiments described herein may be embodied in a variety of other forms; furthermore, various omissions, substitutions and changes in the form of the embodiments described herein may be made without departing from the spirit of the disclosure. The accompanying claims and their equivalents are intended to cover such forms or modifications as would fall within the scope and spirit of the disclosure.

What is claimed is:

1. An image forming apparatus comprising:

a sensor having a light transmitting unit and an array of light receiving units and configured to generate an output signal in accordance with an amount of light received by the light receiving units;

a tray on which sheets are to be stacked;

a gear configured to rotate in accordance with an amount of sheets stacked on the tray;

a protruding portion configured to rotate with the gear and move into a light path of light emitted from the light emitting unit to the light receiving units to partially block light in the light path, the protruding portion having a width that determines how much light in the light path is blocked and varies gradually from a first end thereof to a second end thereof; and a processor configured to determine the amount of sheets stacked on the tray based on the output signal.

2. The image forming apparatus according to claim 1, wherein the array of light receiving units is arranged perpendicular to a direction from the first end of the protruding portion to the second end of the protruding portion.

3. The image forming apparatus according to claim 1, wherein the protruding portion is configured to block at least a part of the light in the light path when the amount of sheets stacked on the tray is maximum.

4. The image forming apparatus according to claim 1, wherein the protruding portion is configured not to block any light in the light path when the amount of sheets stacked on the tray is maximum.

5. The image forming apparatus according to claim 1, wherein the protruding portion is configured to block at least a part of the light in the light path when the amount of sheets stacked on the tray is minimum.

6. The image forming apparatus according to claim 1, wherein the protruding portion is configured not to block any light in the light path when the amount of sheets stacked on the tray is minimum.

7. The image forming apparatus according to claim 1, further comprising:

a display, wherein the processor outputs to the display the amount of sheets stacked on the tray that the processor determines based on the output signal.

8. The image forming apparatus according to claim 1, wherein the protruding portion has an edge that forms a straight line from the first end thereof to the second end when viewed from a direction of the light path of light emitted from the light emitting unit.

9. The image forming apparatus according to claim 1, wherein the protruding portion has an edge that forms a curved line from the first end thereof to the second end when viewed from a direction of the light path of light emitted from the light emitting unit.

10. The image forming apparatus according to claim 1, wherein the protruding portion has an edge that includes a plurality of steps from the first end thereof to the second end when viewed from a direction of the light path of light emitted from the light emitting unit.

11. An image forming apparatus comprising:

a sensor having a light transmitting unit and an array of light receiving units and configured to generate an output signal in accordance with an amount of light received by the light receiving units;

a tray on which sheets are to be stacked;

a gear configured to rotate in accordance with an amount of sheets stacked on the tray;

a protruding portion configured to rotate with the gear and move into a light path of light emitted from the light emitting unit to partially reflect light in the light path to the light receiving units, the protruding portion having a width that determines how much light in the light path is reflected and varies gradually from a first end thereof to the second end thereof; and a processor configured to determine the amount of sheets stacked on the tray based on the output signal.

12. The image forming apparatus according to claim 11, wherein the array of light receiving units is arranged perpendicular to a direction from the first end of the protruding portion to the second end of the protruding portion.

13. The image forming apparatus according to claim 11, wherein the protruding portion is configured to reflect at least a part of the light in the light path when the amount of sheets stacked on the tray is maximum.

14. The image forming apparatus according to claim 11, wherein the protruding portion is configured not to reflect any light in the light path when the amount of sheets stacked on the tray is maximum.

15. The image forming apparatus according to claim 11, wherein the protruding portion is configured to reflect at least a part of the light in the light path when the amount of sheets stacked on the tray is minimum.

16. The image forming apparatus according to claim 11, wherein the protruding portion is configured not to reflect any light in the light path when the amount of sheets stacked on the tray is minimum.

17. The image forming apparatus according to claim 11, further comprising:

a display, wherein the processor outputs to the display the amount of sheets stacked on the tray that the processor determines based on the output signal.

18. A sheet amount detection method comprising:

rotating a gear according to an amount of sheets stacked on a tray;

partially blocking light in a light path by a protruding portion configured to rotate together with the gear, the protruding portion having a width determining a degree of light that is blocked in the light path from a light emitting unit to light receiving units of a sensor, wherein the width of the protruding portion varies gradually from a first end thereof to a second end thereof; and determining the amount of sheets stacked on the tray based on an output signal level of the sensor, wherein the output signal level of the sensor varies according to an amount of light received by the light receiving units.

19. A sheet amount detection method comprising:

rotating a gear according to an amount of sheets stacked on a tray;

partially reflecting light in the light path by a protruding portion configured to rotate together with the gear, the protruding portion having a width that determines a degree of light emitted from a light emitting unit to light receiving units of a sensor, that is reflected, wherein the width of the protruding portion varies gradually from a first end thereof to a second end thereof; and determining the amount of sheets stacked on the tray based on an output signal level of the sensor, wherein the output signal level of the sensor varies according to an amount of light received by the light receiving units.

* * * * *